US007258426B2

(12) United States Patent
Furukawa

(10) Patent No.: US 7,258,426 B2
(45) Date of Patent: Aug. 21, 2007

(54) INK JET HEAD, AND INK JET RECORDING DEVICE AND INK JET PLATE MAKING APPARATUS USING THE SAME

(75) Inventor: Koji Furukawa, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/484,660

(22) Filed: Jul. 12, 2006

(65) Prior Publication Data

US 2007/0013750 A1 Jan. 18, 2007

(30) Foreign Application Priority Data

Jul. 12, 2005 (JP) ..... 2005-202926

(51) Int. Cl.
*B41J 2/06* (2006.01)

(52) U.S. Cl. ..... 347/55

(58) Field of Classification Search ..... 347/55, 347/54, 128, 127, 112, 101, 77, 9
See application file for complete search history.

(56) References Cited

U.S. PATENT DOCUMENTS 6,158,844 A 12/2000 Murakami et al.
6,908,177 B2 * 6/2005 Suganuma ..... 347/55
2004/0183879 A1 * 9/2004 Nakazawa ..... 347/101
2005/0046675 A1 * 3/2005 Aoshima ..... 347/55

FOREIGN PATENT DOCUMENTS

JP 10-138493 A 5/1998

* cited by examiner

*Primary Examiner*—K. Feggins
(74) *Attorney, Agent, or Firm*—Sughrue Mion, PLLC

(57) ABSTRACT

An ink jet head ejects ink as ink droplets through application of an electrostatic force to the ink. The ink jet head includes ejection portions provided with ejection electrodes for applying the electrostatic force to the ink and a shield electrode formed between adjacent ejection portions of the ejection portions for preventing electric field interference from occurring between adjacent ejection electrodes of the adjacent ejection portions, wherein the following formula (1) is satisfied, $Y \leqq 5 \times Va$ (1), where Va [V] is a drive voltage applied to the ejection electrodes, and Y [μm] is an arrangement interval between the adjacent ejection portions. An ink jet recording device records an image corresponding to image data on a recording medium using the ink jet head. An ink jet plate making apparatus forms an image on a printing substrate as the recording medium using the ink jet recording device to make a printing plate.

9 Claims, 7 Drawing Sheets

INK JET HEAD, AND INK JET RECORDING DEVICE AND INK JET PLATE MAKING APPARATUS USING THE SAME

The entire contents of literatures cited in this specification are incorporated herein by reference.

BACKGROUND OF THE INVENTION

The present invention belongs to the field of ink jet recording in which ink is ejected as ink droplets, and relates more specifically to an ink jet head for ejecting ink droplets by causing electrostatic force to act on the ink, and an ink jet recording device and an ink jet plate making apparatus using the ink jet head.

In an electrostatic ink jet recording system, ink having an electric charge is used and ink ejection is controlled by utilizing electrostatic force through application of a predetermined voltage (drive voltage) to ejection electrodes (drive electrodes) of an ink jet head corresponding to image data to record an image corresponding to the image data on a recording medium. For example, the ink jet recording device disclosed in JP 10-138493 A is known as the electrostatic ink jet recording device.

In JP 10-138493 A, there is disclosed the ink jet recording device as an example of the electrostatic ink jet recording device in which ink guides are provided to extend through through holes that function as nozzles from which ink is ejected and ejection electrodes are disposed on the peripheries of the through holes. The ink jet recording device disclosed in JP 10-138493 A generates electric fields around the through holes through application of voltages to the ejection electrodes corresponding to recording data, causing the force from the electric fields act on the meniscuses of the ink formed at the through holes, and ejects the ink droplets from the through holes to a recording medium.

Such the electrostatic ink jet recording system is capable of forming fine droplets and drawing images with high resolution. Specially, the electrostatic ink jet recording system which uses the ink prepared by dispersing charged colorant particles in an insulative solvent hardly causes bleeding of ink dots on a recording medium, so that it can be used for image recording for various recording media.

Such the electrostatic ink jet recording device can be produced at low cost by making the head itself small.

However, in the ink jet head disclosed in JP 10-138493 A, when the ejection portions (channels) are disposed at high density for making the head small (that is, when the ejection portions are disposed in a highly integrated manner), the electric field generated at an ejection portion influences the electric field generated at an adjacent ejection portion, that is, electric field interference occurs between adjacent ejection portions, which may cause a problem in that ink ejection at the ejection portions becomes unstable. Unstable ink ejection would cause an error in ink ejection, displacement of positions to which ink is adhered and the like, thereby making it difficult to form images with high quality and high definition.

Further, when the ejection portions are disposed at high density, it is difficult to maintain the insulating properties between adjacent ejection portions.

SUMMARY OF THE INVENTION

The present invention has been made in order to solve the problems of the conventional techniques described above, and therefore has an object to provide an ink jet head capable of disposing ejection portions at high density and preventing electric field interference from occurring between adjacent ejection portions, and an ink jet recording device and an ink jet plate making apparatus using the ink jet head.

In addition to the above object, another object of the present invention is to provide an ink jet head capable of maintaining the insulating properties between adjacent ejection portions, and an ink jet recording device and an ink jet plate making apparatus using the ink jet head.

Further, preferably, the ink is obtained by dispersing fine particles having at least an electric charge and a colorant in an insulative solvent.

Further, more preferably, the creeping distance X [μm] satisfies the following formula (3).

$$X \geqq 0.3 \times Vb \tag{3}$$

Further, preferably, the potential difference Vb is 1000 V or less.

Preferably, the ink jet head comprises an ejection port substrate in which ejection ports for ejecting ink are formed, and a head substrate which is disposed at a predetermined distance from the ejection port substrate to form an ink flow path between the head substrate and the ejection port substrate, wherein the ejection electrodes are disposed on the peripheries of the ejection ports of the ejection port substrate, respectively.

The shield electrode, when the ejection port substrate plane is viewed from above, preferably has an area which is more spaced apart from the ejection port than an edge portion of the ejection electrode on a side close to the ejection port, and is closer to the ejection port than an edge portion of the ejection electrode on a side apart from the ejection port.

Further, preferably, a convex or concave portion is formed on the ejection port substrate between the two adjacent ejection electrodes.

Further, preferably, a wall part is provided on the ejection port substrate between the two adjacent ejection electrodes.

Further, preferably, the ejection port is formed such that an aspect ratio between a major axis and a minor axis is more than 1.

Further, preferably, the ejection port is formed such that an aspect ratio between a length in an ink flow direction and a length in a direction orthogonal to the ink flow direction is more than 1.

Further, preferably, the ink jet head comprises ink guides each of which is disposed at a position corresponding to the ejection port on the head substrate facing the ejection port substrate and extends through the ejection port so that a tip end portion of each of the ink guides protrudes upwardly from a surface of the ejection port substrate on an opposite side of the head substrate.

Further, preferably, each of the ink guides is formed to have a wide width in accordance with a shape of the ejection port.

Further, preferably, the ink jet head comprises an ink guide dike which is provided on a surface of the head substrate on the ink flow path side and is arranged on the upstream side with respect to the center of the ejection port to form an ink flow directed from the ink flow path to the ejection port.

Further, preferably, the ejection electrode is disposed on the ejection port substrate on the ink flow path side.

According to the present invention, even when the ejection portions are arranged at high density, the electric field interference between adjacent ejection portions can be prevented from occurring. Whereby, it is possible to provide an ink jet head which is compact and produced at low cost, and is capable of forming an image with high quality and high definition, and to provide an ink jet recording device and an ink jet plate making apparatus using the ink jet head.

Moreover, the shield electrode is covered with the insulating layer, so that the insulating property can be maintained between the ejection electrode and the shield electrode. Whereby, the ejection of the ink droplets can be controlled more stably, which makes it possible to form an image with higher quality and definition.

Further, the following formula is satisfied:

$$X \geqq 0.1 \times Vb$$

where X is a creeping distance between the adjacent two ejection electrodes, and Vb is a potential difference between the adjacent ejection electrodes. Whereby, the insulating property can be maintained between the adjacent ejection electrodes.

DETAILED DESCRIPTION OF THE PREFERRED EMBODIMENTS

Hereinafter, an ink jet head, and an ink jet recording device and an ink jet plate making apparatus of the present invention using the ink jet head will be described in detail based on preferred embodiments illustrated in the accompanying drawings.

Figure 1A:
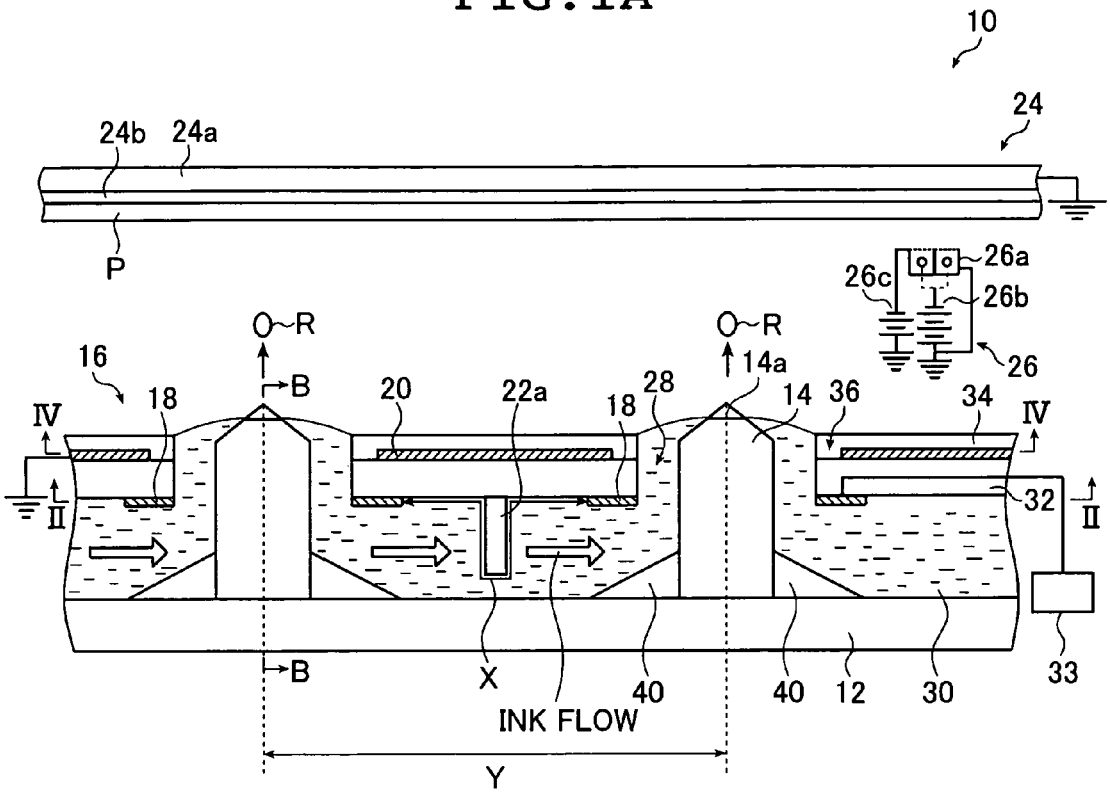
FIG. 1A is a schematic view showing an outlined structure of an ink jet head according to the present invention.
Figure 1B:
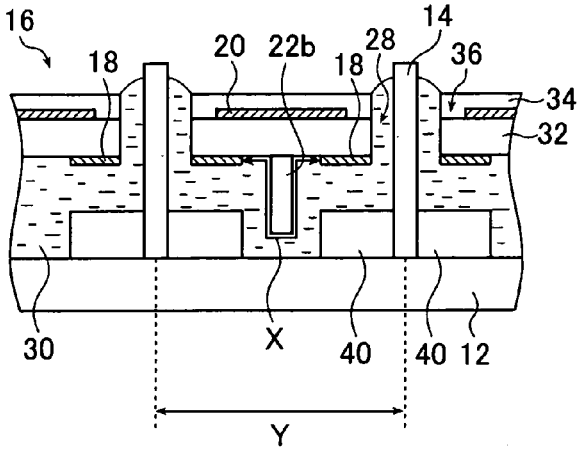
FIG. 1B is a cross sectional view taken along the line B-B in FIG. 1A.

FIG. 1A is a cross sectional view schematically showing an outlined structure of the ink jet head according to the present invention, and FIG. 1B is a cross sectional view taken along the line B-B in FIG. 1A.

As shown in FIG. 1A, an ink jet head 10 includes a head substrate 12, ink guides 14, and an ejection port substrate 16 in which ejection ports 28 are formed. Ejection electrodes 18 are disposed on the ejection port substrate 16 so as to surround the respective ejection ports 28. At a position facing the surface of the ink jet head 10 on an ink ejection side (upper surface in FIG. 1A), a counter electrode 24 supporting a recording medium P is disposed.

The head substrate 12 and the ejection port substrate 16 are disposed so that they face each other with a predetermined distance therebetween. By a space formed between the head substrate 12 and the ejection port substrate 16, an ink flow path 30 for supplying ink to each ejection port 28 is formed. An inter-channel wall 22*a* or 22*b* is disposed between adjacent ejection portions.

In the ink jet head 10 of this embodiment, the ink Q is used in which fine particles containing a colorant such as pigment, and having electrical charges (hereinafter referred to as the "colorant particles") are dispersed in an insulative liquid (carrier liquid). Also, an electric field is generated between the ejection port 28, the ink guide 14, and the counter electrode 24 through application of a drive voltage to the ejection electrode 18 provided in the ejection port substrate 16, and the ink aggregated at the ink guide 14 in the ejection port 28 is ejected by means of electrostatic force. Further, by turning ON/OFF the drive voltage applied to the ejection electrode 18 in accordance with image data (ejection ON/OFF), ink droplets are ejected from the ejection port 28 in accordance with the image data and an image is recorded on the recording medium P.

In order to perform image recording at a higher density and at high speed, the ink jet head 10 has a multi-channel structure in which multiple ejection portions are arranged in a two-dimensional manner. Basically, one ejection portion is composed of the ink guide 14, the ejection electrode 18 and the ejection port 28.

Figure 2:
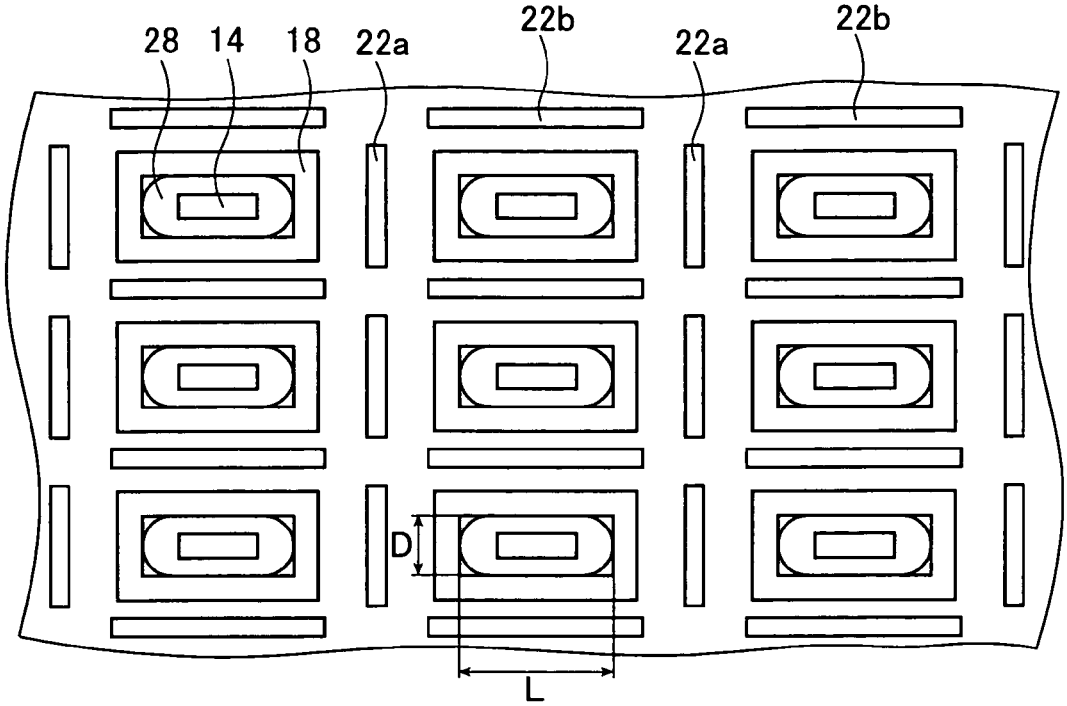
FIG. 2 is a schematic view showing a state where multiple ejection ports are two-dimensionally arranged in the ejection port substrate of the ink jet head.

FIG. 2 is a cross sectional view taken along the line II-II in FIG. 1A and schematically shows a state in which multiple ejection portions of the ink jet head 10 are two-dimensionally formed. In FIGS. 1A and 1B, in order to clarify the structure of the ink jet head, only two of the multiple ejection portions are shown.

In the ink jet head according to the present invention, it is possible to freely choose the number of the ejection portions to be arranged and the physical arrangement positions thereof. For example, the structure may be the multi channel structure shown in FIG. 2 or a structure having only one line of the ejection portions. The ink jet head may be a so-called (full-) line head having lines of ejection portions corresponding to the whole area of the recording medium P or a so-called serial head (shuttle type head) which performs scanning in a direction perpendicular to the nozzle line direction. The ink jet head of the present invention can cope with a monochrome recording device and a color recording device.

It should be noted here that FIG. 2 shows an arrangement of the ejection portions in a part (three rows and three columns) of the multi-channel structure, and the ejection ports 28 of the ejection portions in each row are aligned parallel to an ink flow direction and the ejection ports 28 of the ejection portions in each column are aligned parallel to a direction perpendicular to the ink flow.

In this embodiment, the ejection portions in each row are aligned parallel to the ink flow direction, however, the present invention is not limited thereto, and any arrangement position and arrangement pattern can also be appropriately applied.

Figure 3:
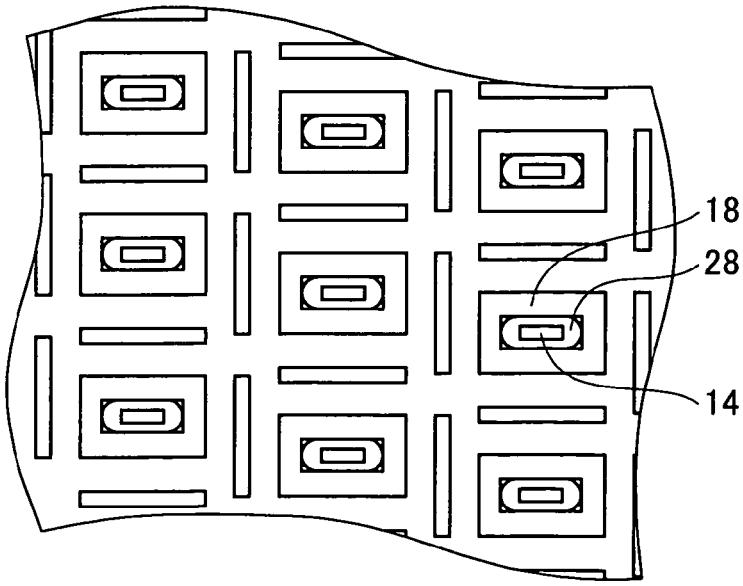
FIG. 3 is a schematic view showing another example of arrangement of the ejection ports in the ejection port substrate.

Specially, as shown in FIG. 3, the ejection ports 28 (of the ejection portions) on a row on a downstream side in the ink flow direction are arranged so that they are displaced from the ejection ports 28 (of the ejection portions) on a row on an upstream side in the ink flow direction by a predetermined pitch in the direction perpendicular to the ink flow. By disposing the ejection ports on the row on the downstream side in the ink flow direction in this manner, it becomes possible to favorably supply ink to the ejection ports.

In the ink jet head according to the present invention, a structure may be used in which an ejection port matrix with n rows and m columns (n and m are each a positive integer), in which ejection ports on a row on the downstream side are arranged so that they are displaced from ejection ports on a row on the upstream side in the direction perpendicular to the ink flow direction, is repeatedly provided in a constant cycle in the ink flow direction, or a structure may be used instead in which the ejection ports are arranged so that they are successively displaced from ejection ports, which are positioned on the upstream side in the ink flow direction, in one direction (vertical direction in FIG. 3) perpendicular to the ink flow. It is possible to appropriately set the number, pitch, and repetition cycle of the ejection portions and the like in accordance with a resolution and a feeding pitch. In the case where the ejection ports in each row are aligned parallel to the ink flow direction, it is preferable that the ejection ports in each row be arranged to be displaced in the ink flow direction with respect to the ejection ports of the adjacent row in the direction perpendicular to the ink flow. Further, the vertical direction in FIG. 3 may be defined as the ink flow direction.

Hereinafter, the structure of the ink jet head 10 of the present invention shown in FIGS. 1A, 1B and 2 will be described in more detail.

As shown in FIG. 1A, the ejection port substrate 16 of the ink jet head 10 includes an insulating substrate 32, a shield electrode 20, and an insulating layer 34. On a surface on an upper side in FIG. 1A (surface opposite to a side facing the head substrate 12) of the insulating substrate 32, the shield electrode 20 and the insulating layer 34 are laminated in order.

Also, on a lower surface side in FIG. 1A (surface on the side facing the head substrate 12) of the insulating substrate 32, the ejection electrodes 18 are disposed. Further, an inter-channel wall 22*a* or 22*b* is disposed between adjacent ejection portions on a lower surface side in FIGS. 1A and 1B of the insulating substrate 32.

The ejection port 28 is formed to extend through the ejection port substrate 16, and the ink droplets R are ejected therefrom.

As shown in FIG. 2, the ejection port 28 is an opening (slit) which is elongated in the ink flow direction and has a cocoon shape that is obtained by connecting a semicircle to each short side of a rectangle. Also, the ejection port 28 has an aspect ratio (L/D) between a length L in the ink flow direction and a length D in a direction orthogonal to the ink flow of 1 or more.

In the present invention, the ejection port 28 whose aspect ratio (L/D) between the length L in the ink flow direction and the length D in the direction orthogonal to the ink flow is 1 or more (an anisotropic shape with its long sides extending in the ink flow direction,.or a long hole with its long sides extending in the ink flow direction) is formed as an opening, so that ink becomes easy to flow to the ejection port 28. That is, the capability of supplying ink particles to the ejection port 28 is enhanced, which makes it possible to improve the frequency responsivity and also prevent clogging. This point will be described later in detail together with the ink droplet ejection action.

In this embodiment, the ejection port 28 is formed as the elongated cocoon-shaped opening, however, the present invention is not limited to this and it is possible to form the ejection port 28 in another arbitrary shape, such as an approximately circular shape, an oval shape, a rectangular shape, a rhomboid shape, or a parallelogram shape, so long as it is possible to eject ink from the ejection port 28 and the aspect ratio between the length in the ink flow direction and the length in the direction orthogonal to the ink flow is 1 or more. For instance, the ejection port may be formed in a rectangular shape whose long sides extend in the ink flow direction, or an oval shape or a rhomboid shape whose major axis extends in the ink flow direction. Also, the ejection port may be formed in a trapezoidal shape with its upper base being on the upstream side of the ink flow, its lower base being on the downstream side, and its height in the ink flow direction being set longer than the lower base. In this case, it does not matter which one of the side on the upstream side and the side on the downstream side is set long. Further, the ejection port may be formed in a shape in which each short side of a rectangle whose long sides extend in the ink flow direction, a circle, whose diameter is longer than the short side of the rectangle, is connected. Also, it does not matter whether the ejection port 28 has a shape in which the upstream side and the downstream side are symmetrical or asymmetrical about its center. For example, at least one of the end portions of a rectangular ejection port on the upstream side and the downstream side may be formed in a semicircular shape.

The ink guide 14 of the ink jet head 10 is produced from a ceramic-made flat plate with a predetermined thickness, and is disposed on the head substrate 12 for each ejection port 28. The ink guide 14 is formed so that it has a somewhat wide width in accordance with the length of the cocoon-shaped ejection port 28 in a long-side direction. As described above, the ink guide 14 extends through the ejection port 28 and its tip end portion 14*a* protrudes upwardly from the surface of the ejection port substrate 16 on the recording medium P side.

The tip end portion 14*a* of the ink guide 14 is formed so that it has an approximately triangular shape (or a trapezoidal shape) that is gradually narrowed as a distance to the counter electrode 24 side is reduced. The ink guide 14 is disposed so that the surface of the tip end portion 14*a* is inclined with respect to the ink flow direction. With this configuration, the ink flowing into the ejection port 28 moves along the inclined surface of the tip end portion 14*a* of the ink guide 14 and reaches the vertex of the tip end portion 14*a*, so a meniscus of ink is formed at the ejection port 28 with stability.

Also, by forming the ink guide 14 so that it is wide in the long-side direction of the ejection port 28, it becomes possible to reduce a width in the direction orthogonal to the ink flow and reduce influence on the ink flow, which makes it possible to form a meniscus to be described later with stability.

It should be noted here that the shape of the ink guide 14 is not specifically limited so long as it is possible to move the colorant particles in the ink Q through the ejection port 28 of the ejection port substrate 16 to be concentrated at the tip end portion 14*a*. For instance, it is possible to change the shape of the ink guide 14 as appropriate to a shape other than the shape in which the tip end portion 14*a* is gradually narrowed toward the counter electrode side. For instance, a slit serving as an ink guide groove that guides the ink Q to the tip end portion 14*a* by means of a capillary phenomenon may be formed in a center portion of the ink guide 14 in a vertical direction in FIG. 1A.

Also, it is preferable that a metal be evaporated onto the extreme tip end portion of the ink guide 14 because the dielectric constant of the tip end portion 14*a* of the ink guide 14 is substantially increased through the evaporation of the metal onto the extreme tip end portion of the ink guide 14. As a result, a strong electric field is generated at the ink guide 14 with ease, which makes it possible to improve the ink ejection property.

As shown in FIGS. 1A, 1B and 2, under the lower surface (surface facing the head substrate 12) of the insulating substrate 32, the ejection electrodes 18 are formed. The ejection electrode 18 has a rectangular frame like shape (square), and is disposed along the rim of the ejection port 28 so as to surround the periphery of the cocoon-shaped ejection port 28. That is, the ejection electrode 18 has a rectangular frame like shape with its opening formed in a rectangular shape. In FIG. 2, the ejection electrode 18 is formed in a rectangular frame like shape, however, it is possible to change the shape of the ejection electrode 18 to various other shapes so long as the ejection electrode is disposed to face the ink guide. For example, the ejection electrode 18 may be a ring shaped circular electrode, an oval electrode, a divided circular electrode, a parallel electrode, a substantially parallel electrode or a channel shaped electrode in which one side of a rectangular frame is removed, corresponding to the shape of the ejection port 28.

As described above, the ink jet head 10 has a multi channel structure in which multiple ejection ports 28 are arranged in a two-dimensional manner. Therefore, as schematically shown in FIG. 2, the ejection electrodes 18 are respectively disposed for the ejection ports 28 in a two-dimensional manner.

Also, the ejection electrodes 18 are exposed to the ink flow path 30 and are in contact with the ink Q flowing in the ink flow path 30. Thus, it becomes possible to significantly improve the ink droplets ejecting property. This point will be described in detail later together with the ink droplet ejection action.

As shown in FIG. 1A, the ejection electrode 18 is connected to a control unit 33 which is capable of controlling a voltage value and a pulse width of a drive voltage applied to the ejection electrode 18 at the time of ejection and non-ejection of ink.

Figure 4:
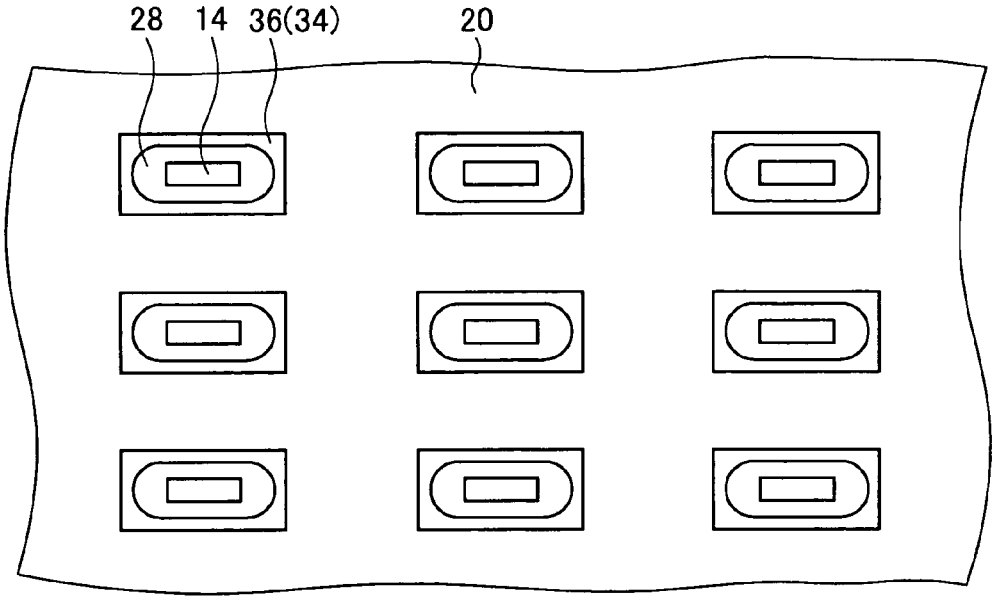
FIG. 4 is a schematic view showing a planar structure of a shield electrode in the ink jet head having a multi channel structure.

The shield electrode 20 is formed on the surface of the insulating substrate 32, and the surface of the shield electrode 20 is covered with the insulating layer 34. In FIG. 4, a planar structure of the shield electrode 20 is schematically shown. FIG. 4 is a view taken along the line IV-IV in FIG. 1A and schematically shows the planar structure of the shield electrode 20 of the ink jet head having a multi channel structure. As shown in FIG. 4, the shield electrode 20 is a sheet-shaped electrode, such as a metallic plate, which is common to the ejection electrodes and has openings 36 at positions corresponding to the ejection electrodes 18 respectively formed on the peripheries of the ejection ports 28 arranged in a two-dimensional manner. Each of the openings 36 of the shield electrode 20 is formed in a rectangular shape so that it has a length and a width exceeding the length and the width of the ejection port.

It is possible for the shield electrode 20 to suppress the electric field interference by shielding against electric lines of force between adjacent ejection electrodes 18, and a predetermined voltage (including 0 V when grounded) is applied to the shield electrode 20. In the illustrated example, the shield electrode 20 is grounded and hence has 0 V as the applied voltage.

As a preferred embodiment, as shown in FIG. 1A, the shield electrode 20 is formed in a layer different from that containing the ejection electrodes 18, and moreover, its whole surface is covered with the insulating layer 34.

The ink jet head 10 has such insulating layer 34, so that the electric field interference between adjacent ejection electrodes 18 can be suitably prevented. Moreover, discharging between the ejection electrode 18 and the shield electrode 20 can also be prevented even when the colorant particles of the ink Q are formed into a coating.

The shield electrode 20 needs to be provided so as to block the electric lines of force of the ejection electrodes 18 provided on other ejection ports 28 (hereinafter referred to as "other channels") and the electric lines of force directed to the other channels while ensuring the electric lines of force acting on the corresponding ejection port 28 (hereinafter referred to as "own channel" for convenience) among the electric lines of force generated from the ejection electrodes 18.

When the shield electrode 20 is not provided, at the time of ejection of ink droplets, the electric lines of force generated from the end portion on an ejection port side of the ejection electrode 18 (hereinafter referred to as the "inner edge portion of the ejection electrode") converge inside the ejection electrode 18, that is, in the area surrounded by the inner edge portion of the ejection electrode 18, act on the own channel, and generate an electric field necessary for ink droplet ejection. On the other hand, the electric lines of force generated from the end portion on a side opposite to the ejection port side of the ejection electrode 18 (hereinafter referred to as the "outer edge portion of the ejection electrode") diverge further outside from the outer edge portion of the ejection electrode 18, exert influence on other channels, and cause the electric field interference.

If the above points are taken into consideration, the width and the length of the rectangular opening 36 of the shield electrode 20, when the substrate plane is viewed from above, is preferably made larger than the width and the length defined by the inner edge portion of the ejection electrode 18 of the own channel to avoid shielding against the electric lines of force directed to the own channel. Specifically, the end portion of the shield electrode 20 on the ejection port 28 side is preferably more spaced apart (retracted) from the ejection port 28 than the inner edge portion of the ejection electrode 18 of the own channel.

In addition, for the efficient shielding against the electric lines of force directed to the other channels, the length and the width of the rectangular opening 36 of the shield electrode 20, when the substrate plane is viewed from above, is preferably made smaller than the length and the width defined by the outer edge portion of the ejection electrode 18 of the own channel. Specifically, the end portion of the shield electrode 20 on the ejection port 28 side is preferably closer (advanced) to the ejection port 28 than the outer edge portion of the ejection electrode 18 of the own channel. According to the studies made by the inventor of the present invention, the distance between the outer edge portion of the ejection electrode 18 and the end portion of the shield electrode 20 is preferably equal to or larger than 5 μm, more preferably equal to or larger than 10 μm.

With the above construction, the electric field interference between adjacent ejection portions can be prevented from occurring. Whereby, stability in ejecting ink droplets from the ejection port 28 is ensured, variations in an ink adhering position is suitably suppressed, and thus a high quality image can be consistently recorded.

The shield electrode is disposed in such a manner, so that the electric field interference between adjacent ejection portions can be prevented from occurring. Thus, the ejection portions can be arranged in such a manner as to satisfy the following formula (1):

$$Y \leqq 5 \times Va \quad (1)$$

wherein Va [V] is a drive voltage applied to the ejection electrode 18, and Y [μm] is an arrangement interval of the ejection portions, specifically, a distance between the centers of two adjacent ejection portions, that is, the distance between the center of an ejection portion (in this embodiment, the center of the ejection port 28) and the center of an ejection portion adjacent thereto.

That is to say, even in the case where the ejection portions are arranged to satisfy the above formula (1), the ink jet head capable of preventing the electric field interference can be realized by disposing the shield electrode.

By arranging the ejection portions so that the arrangement interval Y satisfies the above formula (1), the ejection portions can be arranged at high density (that is, the ejection portions can be arranged in a highly integrated manner). The ejection portions arranged at high density can realize the compact ink jet head 10, which makes it possible to increase the number of head parts produced in one process. Further, it becomes possible to reduce the amount of materials required for producing a head, which makes it possible to reduce the production cost. Consequently, the ink jet head 10 can be produced at a lower cost.

Also, since the ink jet head can be compact, the carriage used in the case where the head performs scanning can also be small, enabling downsizing of the apparatus as a whole.

As described above, according to the present invention, even when the ejection portions are arranged at high density, it is possible to prevent the electric field interference between the adjacent ejection portions from occurring. Thus, images with high resolution and high quality can be formed, and a compact ink jet head can be produced at low cost.

The arrangement interval Y between adjacent ejection portions is preferably 2 mm or less. Whereby, the ink jet head can be smaller, resulting in further lowering the cost.

In the above example, the ejection electrode 18 is explained as a rectangular electrode (rectangular frame shaped electrode). In the case where the ejection electrode 18 is not a rectangular electrode, it is sufficient that the arrangement interval Y is determined in consideration of a substantial diameter of the ejection electrode such as an average diameter depending upon the shape of the ejection electrode. Alternatively, the shield electrode 20 may be provided (that is, each opening 36 of the shield electrode 20 may be formed) so that the shape of each opening 36 of the shield electrode 20 is made substantially similar to the shape formed by the inner edge portion or the outer edge portion of the ejection electrode 18, and the opening edge of the shield electrode 20 is more spaced apart (retracted) from the ejection port 28 than the inner edge portion of the ejection electrode 18 of the own channel and is closer (advanced) to the ejection port 28 than the outer edge portion of the ejection electrode 18.

Also, in the above example, the shield electrode 20 is a sheet-shaped electrode, however, the present invention is not limited to this and the shield electrode 20 may have any other shapes or structures so long as it is possible to shield the respective ejection ports against the electric lines of force of other channels. For instance, the shield electrode 20 may be provided between respective ejection ports in a mesh shape.

Even in this case, it is sufficient that the shield electrode 20 is formed so that the opening edge of the shield electrode 20 is more spaced apart from the ejection port 28 than the inner edge portion of the ejection electrode 18 of the own channel and is closer to the ejection port 28 than the outer edge portion of the ejection electrode 18 of the own channel.

The shape of each opening 36 of the shield electrode 20 is approximately the same as the shape of the ejection port 28, however, the present invention is not limited to this and the openings of the shield electrode 20 may have another arbitrary shape so long as it is possible to prevent electric field interference from occurring by shielding against electric lines of force between adjacent ejection electrodes 18. For instance, it is possible to form each opening 36 of the shield electrode 20 in a circular shape, an oval shape, a square shape, or a rhomboid shape.

As a preferable form, the ink jet head 10 of this embodiment is provided with the inter-channel walls 22*a* and 22*b* on the ejection port substrate 16 on the ink flow path 30 side between adjacent ejection portions (ejection electrodes). Each inter-channel wall 22*a* is arranged on the surface of the ejection port substrate 16 on the ink flow path 30 side between two ejection electrodes 18 adjacent in the ink flow direction, and each inter-channel wall 22*b* is arranged between two ejection electrodes 18 adjacent in the direction orthogonal to the ink flow direction.

The inter-channel walls 22 are provided on the ejection port substrate 16 on the ink flow path 30 side, so that the creeping distance between two adjacent ejection electrodes 18 (hereinafter, also referred simply to as "creeping distance between the ejection electrodes 18") has a predetermined length or more. Specifically, the following formula (2) is satisfied:

$$X \geqq 0.1 \times Vb \quad (2)$$

wherein X [μm] is a creeping distance between two adjacent ejection electrodes 18, and Vb [V] is a potential difference between the two adjacent ejection electrodes 18, specifically, the maximum potential difference generated between the two adjacent ejection electrodes 18 during image recording.

The creeping distance X satisfies the above formula (2). Thus, even when the ejection portions are arranged at high density and the arrangement interval between the adjacent ejection portions is set to, for example, 2 mm or less, it is possible to maintain the insulating properties between the two adjacent ejection electrodes 18. Whereby, the ink jet head can be compact, and the insulating properties between the two adjacent ejection electrodes 18 can be maintained. That is, the ink jet head which is safe can be realized at low cost.

Specifically, when the potential difference Vb between two adjacent ejection electrodes 18 is 300V, the creeping distance X between the two adjacent ejection electrodes 18 is set to 30 μm or more, thereby enabling the insulating properties between the two adjacent ejection electrodes 18 to be maintained.

The shape of the inter-channel walls 22*a* and 22*b* is not specifically limited, and the inter-channel walls 22*a* and 22*b* may have various other shapes whose cross section is a rectangle, a trapezoid, a semicircle, an oval, a triangle or the like.

When the linear distance between two adjacent ejection electrodes differs depending upon the selected ejection electrodes, the inter-channel wall with different size may be disposed corresponding to the linear distance. For example, as in this embodiment, when the linear distance between two ejection electrodes adjacent in the ink flow direction is longer than the linear distance between two ejection electrodes adjacent in the direction orthogonal to the ink flow direction, the inter-channel wall 22*a* may have a smaller size than the inter-channel wall 22*b*. Also, so long as the creeping distance X satisfies the above formula (2), the inter-channel walls may not be provided between the ejection electrodes in the ink flow direction, and only the inter-channel walls 22*b* may be disposed. That is, in the case where the linear distance between two ejection electrodes adjacent in the ink flow direction can satisfy the above formula (2) as the creeping distance X, the structure may be such that the inter-channel walls are provided only between the ejection electrodes adjacent in the direction orthogonal to the ink flow direction.

It is preferable that the following formula (3) be satisfied $$X \geqq 0.3 \times Vb \quad (3)$$

wherein X [μm] is a creeping distance between two adjacent ejection electrodes 18, and Vb [V] is a potential difference between the two adjacent ejection electrodes 18.

The above formula (3) is satisfied, so that the above effects can be obtained more favorably.

The potential difference Vb between two adjacent ejection electrodes 18 is preferably 1000V or less. By setting the potential difference Vb to 1000V or less, the cost for the parts used for the power source and the control circuit can be reduced, so that the recording apparatus can be provided at a lower cost.

The ink jet head 10 shown in FIGS. 1A and 1B is provided with the inter-channel walls 22*a* and 22*b* between the ejection portions, however, the present invention is not limited thereto. Instead of disposing the inter-channel walls 22*a* and 22*b*, the shape of the ejection port substrate may be changed so that the creeping distance X between the ejection electrodes satisfies the above formula (2).

Figure 5A:
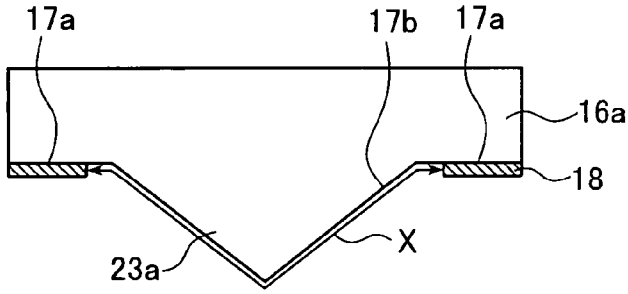
FIGS. 5A to 5C are views showing other examples of the shape of the ejection port substrate.
Figure 5B:
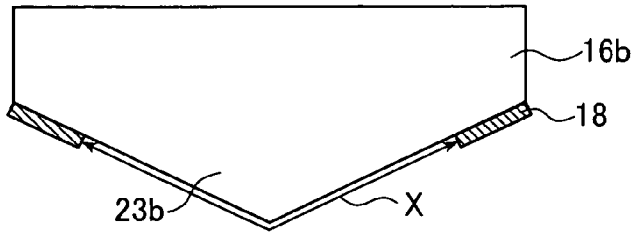

For example, as shown in FIG. 5A, the surface of an ejection port substrate 16*a* on the ink flow path side may be composed of first surfaces 17*a* which are parallel to the surface of the ejection port substrate 16*a* on the counter electrode side and on which the ejection electrodes 18 are disposed, and a second surface 17*b* that inclines so as to become gradually closer to the head substrate as the distance from the ejection electrodes 18 is increased. That is, the surface of the ejection port substrate 16*a* on the ink flow path side may be formed to have a convex portion 23*a* between the first surfaces 17*a*. An ejection port substrate 16*b* shown in FIG. 5B is another example of the shape of the surface of the ejection port substrate 16 on the ink flow path side. As shown in FIG. 5B, the surface of the ejection port substrate 16*b* on the ink flow path side may only be composed of a surface that inclines so as to become gradually closer to the head substrate as the distance from the ejection ports is increased. That is, the surface of the ejection port substrate 16*b* on the ink flow path side may be formed to have a convex portion 23*b* so that the cross section of the ejection port substrate 16*b* is a pentagon.

Figure 5C:
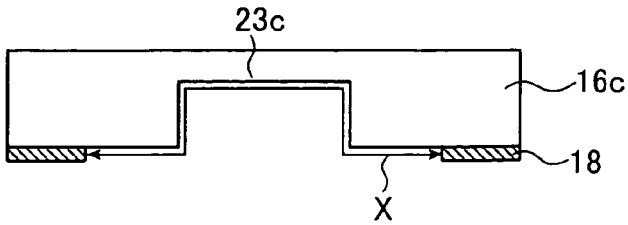

It is possible to increase the creeping distance X not by forming a convex portion but by forming a concave portion on the ejection port substrate. For example, as an ejection port substrate 16*c* shown in FIG. 5C, a concave portion 23*c* may be formed between the adjacent ejection electrodes 18, that is, a part of the surface of the ejection port substrate on the ink flow path side may be recessed.

As above, the convex or concave portion is formed on the ejection port substrate, so that the creeping distance X between two adjacent ejection electrodes can be longer than the linear distance therebetween. Whereby, the arrangement interval between two adjacent ejection electrodes can be shorter. Thus, the ink jet head can be further downsized.

In the above embodiments, the creeping distance X satisfies the above formula (2) by forming the surface of the ejection port substrate on the ink flow path side in various shapes, or by providing the inter-channel walls on the surface of the ejection port substrate on the ink flow path side between adjacent ejection electrodes. However, the ejection port substrate may have any arbitrary shape, and the ejection port substrate may not be provided with a convex or concave portion so long as the creeping distance X between two adjacent ejection electrodes satisfies the above formula (2).

In the ink jet head 10 in this embodiment, as a preferable form, ink guide dikes 40 that guide ink to the ejection port 28 are provided on the head substrate 12. The ink guide dike 40 will be described below.

Figure 6A:
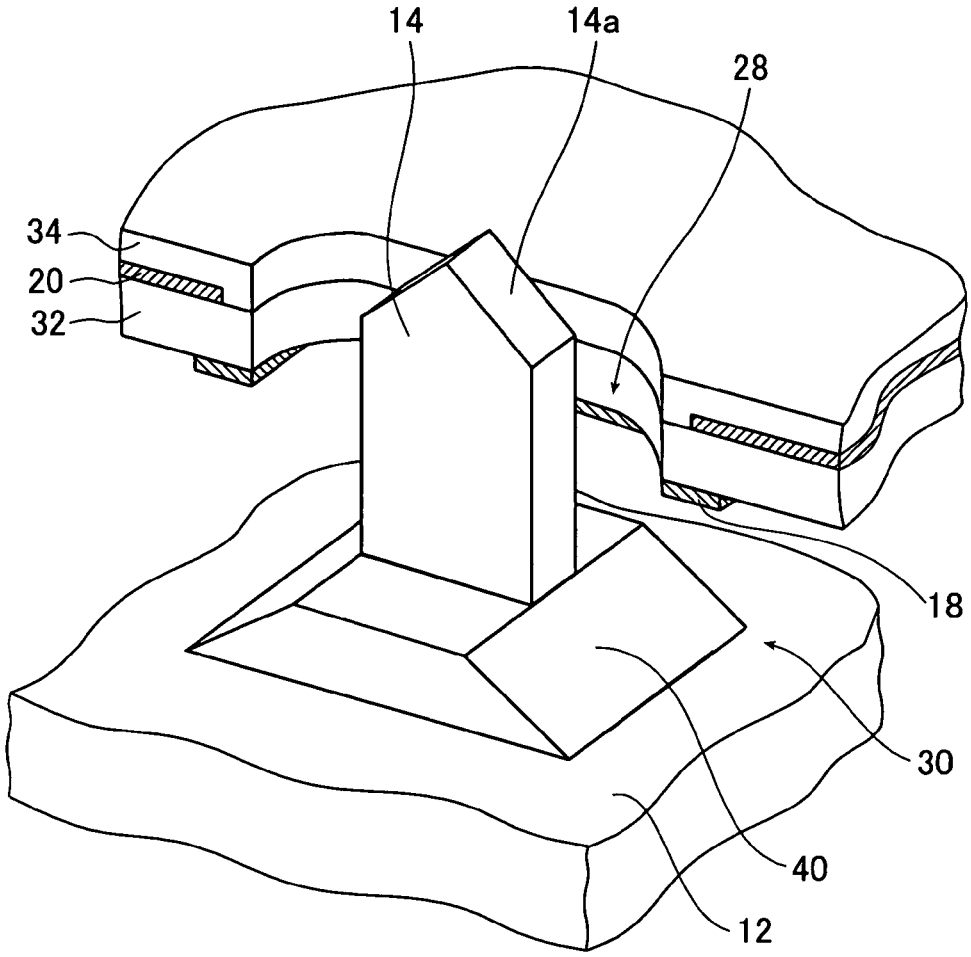
FIG. 6A is a partial cross sectional perspective view showing a structure in the vicinity of the ejection portion in the ink jet head shown in FIG. 1A.

FIG. 6A is a partial cross sectional perspective view showing a structure in the vicinity of the ejection portion in the ink jet head 10 shown in FIG. 1A. In FIG. 6A, in order to demonstrate clearly the structure of the ink guide dike 40, the vicinity of one ejection port 28 is shown by cutting the ejection port substrate 16 and the ejection electrode 18 along the ink flow direction at the substantially central position of the ink guide 14.

The ink guide dikes 40 are disposed on the surface of the head substrate 12 on the ink flow path 30 side, i.e., on the bottom surface of the ink flow path 30. More specifically, the ink guide dikes 40 are respectively-disposed on the upstream side and the downstream side in the ink flow direction with respect to the ink guide 14 which is disposed at a position corresponding to the ejection port 28. The ink guide dike 40 has a surface which inclines so as to become gradually closer to the ejection port substrate 16 toward the center of the ejection port 28 in the ink flow direction. That is, the ink guide dike 40 is formed in a shape inclining toward the ejection port 28 along the ink flow direction.

In addition, the ink guide dikes 40 are provided at a predetermined distance from the surface of the ejection port substrate 16 on the ink flow path 30 side, i.e., from the upper surface of the ink flow path 30 so as to ensure the flow path of the ink Q without blocking up the ejection port 28. Such ink guide dikes 40 are provided for each ejection portion.

The ink guide dike 40 inclining toward the ejection port 28 along the ink flow direction is provided on the bottom surface of the ink flow path 30, so that the ink flow directed to the ejection port 28 is formed and hence the ink Q is guided to the opening of the ejection port 28 on the ink flow path 30 side. Thus, it is possible to suitably make the ink Q to flow to the inside of the ejection port 28, enabling enhancement of the ink particles supplying property. Further, it is possible to more surely prevent the ejection port 28 from being clogged.

Figure 6B:
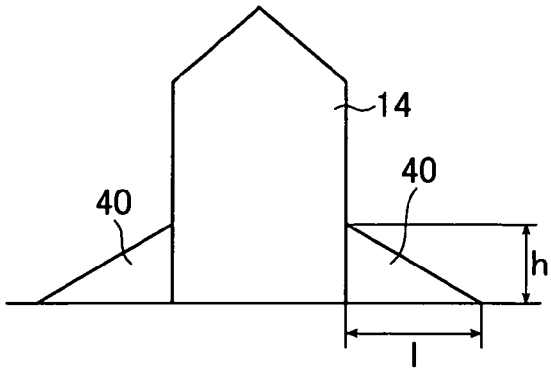
FIG. 6B is a cross sectional view showing the geometry of an ink guide dike.

A length l of the ink guide dike 40 in the ink flow direction has to be properly set within a range in which the ink guide dike 40 does not interfere with any of the adjacent ejection ports so that the ink Q can be suitably guided to the ejection port 28. Thus, as shown in FIG. 6B, the length l of the ink guide dike 40 is preferably 3 or more times as large as a height h ($l/h \geqq 3$) of the highest portion of the ink guide dike 40, and is more preferably 8 or more times as large as the height h (l/h≧8) of the highest portion of the ink guide dike 40.

The width of the ink guide dike 40 in the direction intersecting perpendicularly the ink flow direction is preferably equal to that of the ejection port 28 or slightly wider than that of the ejection port 28. In addition, the ink guide dike 40 is not limited to the illustrated example having a uniform width. There may also be adopted an ink guide dike having a gradually decreasing width, an ink guide dike having a gradually increasing width, or the like. In addition, each side wall of the ink guide dike 40 is not limited to the one having a vertical plane, and hence may also be the one having an inclined plane or the like.

The inclined surface (ink guide surface) of the ink guide dike 40 need only have a shape which is suitable for guiding the ink Q to the ejection port 28. Thus, a slope having a fixed angle of inclination may be adopted for the inclined surface of the ink guide dike 40. Or, a surface having different angles of inclination, or a curved surface may also be adopted for the inclined surface of the ink guide dike 40. In addition, the inclined surface of the ink guide dike 40 is not limited to a smooth surface. Thus, one or more ridges, grooves or the like may be formed along the ink flow direction, or radially toward the central portion of the ejection port 28 on the inclined surface of the ink guide dike 40.

In addition, the perimeter of the bottom surface of the ink guide 14 may be rounded unlike the illustrated example to be smoothly connected to the upper surface of the ink guide dike 40.

In the illustrated example, there is adopted a form in which the ink guide dikes 40 are disposed on the upstream and downstream sides of the ink guide 14, respectively. However, alternatively, there may also be adopted a form in which a trapezoidal ink guide dike 40 having slopes on the upstream and downstream sides of the ejection port 28, respectively, is provided, and the ink guide 14 is erected on the upper portion of this trapezoidal ink guide dike 40. Or, the ink guide 14 and the ink guide dike 40 may be formed integrally with each other. As described above, the ink guide dike 40 may be formed separately from or integrally with the ink guide 14 to be mounted on the head substrate 12, or may also be formed by digging the head substrate 12 using the conventionally known digging means.

It should be noted that while the ink guide dike 40 has to be provided on the upstream side of the center of the ejection port 28, however, as in the illustrated example, the ink guide dike 40 is preferably provided on the downstream side as well of the ejection port 28 so that its height in the direction of ejection of the ink droplet R becomes lower as a distance from the center of the ejection port 28 is increased. As a result, the ink Q which has been guided toward the ejection port 28 by the ink guide dike 40 on the upstream side smoothly flows into the downstream side. Hence, the stability of ink flow can be maintained without a turbulent flow of the ink Q, enabling ejection stability to be maintained.

In the example shown in FIGS. 6A and 6B, the ink guide dike 40 is disposed on the upper surface of the head substrate 12. However, the present invention is not limited to this and there may also be adopted a structure in which an ink flow groove is provided in the head substrate 12, and the ink guide dike is disposed inside the ink flow groove.

For example, the ink flow groove having a predetermined depth is provided so as to include a position corresponding to the ejection port 28 along the ink flow direction. Further, there is provided an ink guide dike having the surface inclining toward the ejection port 28 along the ink flow direction in the position corresponding to the ejection port. In such a manner, the provision of the ink flow groove allows most of the ink Q flowing through the ink flow path 30 to selectively flow in the ink flow groove, and the provision of the ink guide dike allows the ink Q to suitably flow to the inside of the ejection port 28. Hence, it is possible to enhance the ink supplying property to the tip end portion 14*a* of the ink guide 14.

As shown in FIG. 1A, the counter electrode 24 is disposed so as to be opposed to the surface of the ink jet head 10 from which the ink droplets R are ejected.

The counter electrode 24 is disposed at a position facing the tip end portion 14*a* of the ink guide 14, and includes an electrode substrate 24*a* which is grounded, and an insulating sheet 24*b* which is disposed on the lower surface of the electrode substrate 24*a* in FIG. 1A, that is, on the surface of the electrode substrate 24*a* on the ink jet head 10 side.

The recording medium P is supported on the lower surface of the counter electrode 24 in FIG. 1A, that is, on the surface of the insulating sheet 24*b* by electrostatic attraction for example. The counter electrode 24 (the insulating sheet 24*b*) functions as a platen for the recording medium P.

At least during recording, the recording medium P held on the insulating sheet 24*b* of the counter electrode 24 is charged by the charging unit 26 to a predetermined negative high voltage opposite in polarity to that of the drive voltage applied to the ejection electrode 18.

As a result, the recording medium P is charged negative to be biased to the negative high voltage to function as the substantial counter electrode to the ejection electrode 18, and is electrostatically attracted to the insulating sheet 24*b* of the counter electrode 24.

The charging unit 26 includes a scorotron charger 26*a* for charging the recording medium P to a negative high voltage, a high voltage power source 26*b* for supplying a negative high voltage to the scorotron charger 26*a*, and a bias voltage source 26*c*. Note that the corona wire of the scorotron charger 26*a* is connected to the terminal of the high voltage power source 26*b* on the negative side, and the terminal of the high voltage power source 26*b* on the positive side and the metallic shield case of the scorotron charger 26*a* are grounded. The terminal of the bias voltage source 26*c* on the negative side is connected to the grid electrode of the scorotron charger 26*a*, and the terminal of the bias voltage source 26*c* on the positive side is grounded.

The charging means of the charging unit 26 used in the present invention is not limited to the scorotron charger 26*a*, and hence various discharge means such as a scorotron charger, a solid-state charger and an electrostatic discharge needle can be used.

In addition, in the illustrated embodiment, the counter electrode 24 includes the electrode substrate 24*a* and the insulating sheet 24*b*, and the charging unit 26 is used to charge the recording medium P to a negative high voltage to apply a bias voltage to the medium P so that the medium P functions as the counter electrode and is electrostatically attracted to the surface of the insulating sheet 24*b*. However, this is not the sole case of the present invention and another configuration is also possible in which the counter electrode 24 is constituted only by the electrode substrate 24*a*, and the counter electrode 24 (electrode substrate 24*a*) is connected to a bias voltage power source for supplying a negative high voltage and is always biased to the negative high voltage so that the recording medium P is electrostatically attracted to the surface of the counter electrode 24.

Further, the electrostatic attraction of the recording medium P to the counter electrode 24, the charge of the recording medium P to the negative high voltage, and the application of the negative high bias voltage to the counter electrode 24 may be performed using separate negative high voltage sources. Also, the support of the recording medium P by the counter electrode 24 is not limited to the utilization of the electrostatic attraction of the recording medium P, and hence any other supporting method or supporting means may be used for the support of the recording medium P by the counter electrode 24.

Examples of the supporting means of the recording medium P include means that applies a mechanical method such as fixing means of supporting the forward and rear ends of the recording medium P, a pressing roller or the like, and means that applies a method in which suction holes communicating with a suction unit are formed in the surface of the counter electrode 24 facing the ink jet head 10 and the recording medium is fixed on the counter electrode by the suction force from the suction holes.

The ejection action of the ink droplets R from the ink jet head 10 will be described detail below.

As shown in FIG. 1A, in the ink jet head 10, the ink Q, which contains colorant particles charged with the same polarity (for example, charged positively) as that of a voltage applied to the ejection electrode 18 at the time of recording, circulates in an arrow direction (from left to right in FIG. 1A) in the ink flow path 30 by a not shown ink circulation mechanism including a not shown pump and the like.

On the other hand, upon recording, the recording medium P is supplied to the counter electrode 24 and is charged to have the polarity opposite to that of the colorant particles, that is, a negative high voltage by the charging unit 26. While being charged to the bias voltage, the recording medium P is electrostatically attracted to the counter electrode 24.

In this state, the control unit 33 performs control so that a pulse voltage (hereinafter referred to as a "drive voltage") is applied to each ejection electrode 18 in accordance with supplied image data while relatively moving the recording medium P (counter electrode 24) and the ink jet head 10. Ejection ON/OFF is basically controlled depending on application ON/OFF of the drive voltage, whereby the ink droplets R are modulated in accordance with the image data and ejected to record an image on the recording medium P.

When the drive voltage is not applied to the ejection electrode 18 (or the applied voltage is at a low voltage level), i.e., in a state where only the bias voltage is applied, Coulomb attraction between the bias voltage and the charges of the colorant particles (charged particles) of the ink Q, Coulomb repulsion among the colorant particles, viscosity, surface tension and dielectric polarization force of the carrier liquid, and the like act on the ink Q, and these factors operate in conjunction with one another to move the colorant particles and the carrier liquid. Thus, the balance is kept in a meniscus shape as conceptually shown in FIG. 1A in which the ink Q slightly rises from the ejection port 28.

In addition, the colorant particles aggregate at the ejection port 28 due to the electric field generated between the negatively charged recording medium P and the ejection electrode 18. The above described Coulomb attraction and the like allow the colorant particles to move toward the recording medium P charged to the bias voltage through a so-called electrophoresis process. Thus, the ink Q is concentrated in the meniscus formed at the ejection port 28.

From this state, the drive voltage is applied to the ejection electrode 18. Whereby, the drive voltage is superposed on the bias voltage. Then, the motion occurs in which the previous conjunction motion operates in conjunction with the superposition of the drive voltage. The electrostatic force acts on the colorant particles and the carrier liquid by the electric field generated by the application of the drive voltage to the ejection electrode 18. Thus, the colorant particles and the carrier liquid are attracted toward the bias voltage (counter electrode) side, i.e., the recording medium P side by the electrostatic force. The meniscus formed in the ejection port grows upward in FIG. 1A (toward the recording medium P side) to form a nearly conical ink liquid column, i.e., a so-called Taylor cone upward of the ejection port 28 (that is, extending in a direction from the ejection port 28 to the recording medium P). In addition, similarly to the foregoing, the colorant particles are moved to the meniscus surface through electrophoresis process and the action of the electric field from the ejection electrode so that the ink Q at the meniscus is concentrated and has a large number of colorant particles at a nearly uniform high concentration.

When a finite period of time further elapses after the start of the application of the drive voltage to the ejection electrode 18, the balance mainly between the force acting on the colorant particles (Coulomb force and the like) and the surface tension of the carrier liquid is broken at the tip portion of the meniscus having the high electric field strength due to the movement of the colorant particles or the like. As a result, the meniscus abruptly grows to form a slender ink liquid column called a thread having about several μm to several tens of μm in diameter.

When a finite period of time further elapses, the thread grows, and is divided due to the interaction resulting from the growth of the thread, the vibrations generated due to the Rayleigh/Weber instability, the ununiformity in distribution of the colorant particles within the meniscus, the ununiformity in distribution of the electrostatic field applied to the meniscus, and the like. Then, the divided thread is ejected and flown in the form of the ink droplets R toward the recording medium P and is attracted by the bias voltage as well to adhere to the recording medium P. The growth of the thread and its division, and moreover the movement of the colorant particles to the meniscus (thread) are continuously generated while the drive voltage is applied to the ejection electrode. Therefore, the amount of ink droplets ejected per pixel can be controlled by adjusting the time when the drive voltage is applied.

After the end of the application of the drive voltage (ejection is OFF), the meniscus returns to the above-mentioned state where only the bias voltage is applied to the recording medium P.

As described above, the ink jet head of the present invention is provided with the shield electrode, so that even when the ejection portions are arranged so as to satisfy the above formula (1), the electric field interference can be prevented from occurring between the adjacent ejection portions. Whereby, ink droplets can be properly ejected with stability, enabling a high quality image to be drawn at high speed.

The creeping distance X between two adjacent ejection electrodes is set to satisfy the above formula (2), so that even when the potential difference between the adjacent ejection electrodes occurs during image recording, the insulating properties between the ejection electrodes can be maintained. Whereby, an image can be stably formed.

As shown in FIGS. 1A and 1B, the ejection port in the ink jet head of this embodiment is a slit like long hole elongated in the ink flow direction. By forming the ejection port 28 in the shape of a slit like long hole elongated in the ink flow direction, that is, by setting the aspect ratio of the ejection port 28 between the length in the ink flow direction and the length in the direction orthogonal to the ink flow at 1 or more, ink becomes easy to flow to the inside of the ejection port and the capability of supplying ink particles to the ejection port 28 can be enhanced. That is, the capability of supplying ink particles to the tip end portion 14*a* of the ink guide 14 is enhanced, which makes it possible to improve ejection frequency at the time of image recording. Therefore, even when dots are drawn continuously at high speed, dots of desired size can be consistently formed on the recording medium. In addition, by setting the aspect ratio of the ejection port at 1 or more, the ink flows smoothly and the ejection port can be prevented from being clogged with the ink.

In view of the output time of an image, the ejection frequency for drawing an image is set at 5 kHz, preferably at 10 kHz, and more preferably at 15 kHz.

It is preferable that the aspect ratio of the ejection port between the length in the ink flow direction and the length in the direction orthogonal to the ink flow direction be 1.5 or more.

By setting the aspect ratio at 1.5 or more, the capability of supplying ink to the ink guide can be enhanced. Thus, it is possible to continuously form large dots with more stability, and to perform drawing at a higher drawing frequency.

The above effects can be more advantageously achieved by forming the ejection port such that the aspect ratio between the length in the ink flow direction and the length in the direction orthogonal to the ink flow is 1 or more as in the above embodiment. Moreover, by setting the aspect ratio of the ejection port between the major axis and the minor axis at 1 or more, ink can flow smoothly and the ejection port can be prevented from being clogged with ink.

It is preferable that the ejection electrode have a shape in which a part thereof on the upstream side in the ink flow direction is removed. Thus, an electric field which prevents colorant particles from flowing into the ejection port from the upstream side in the ink flow direction is not formed, whereby the colorant particles can be effectively supplied to the ejection port. In addition, since a part of the ejection electrode is disposed on the downstream side with respect to the ejection port in the ink flow direction, an electric field is formed in such a direction that colorant particles having flowed into the ejection port is kept at the ejection port. Accordingly, by forming the ejection electrode into a shape in which a part thereof on the upstream side in the ink flow direction is removed, it is also possible to enhance the capability of supplying particles to the ejection port.

FIGS. 7A to 7F are schematic views showing various forms of the ejection electrode. In FIGS. 7A to 7F, ink flows from left to right.

Figure 7A:
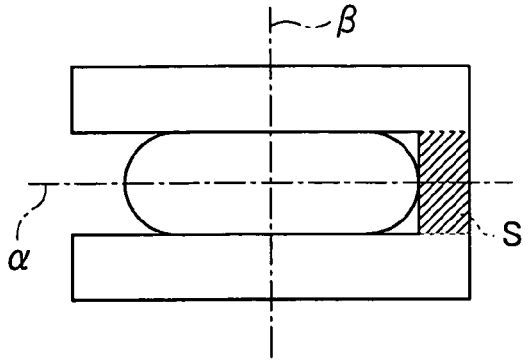
FIGS. 7A to 7F are schematic views showing other examples of the shape of the ejection electrode.

The ejection electrode in FIG. 7A is formed to be symmetric with respect to the surface which passes through the center of the ejection port and is parallel to the major axis direction of the ejection port (shown by a line α in FIG. 7A). Further, if a shaded area S of the ejection electrode in FIG. 7A is removed, it is preferable that each remaining long side part of the ejection electrode formed in the major axis direction of the ejection port be symmetric with respect to the surface which passes through the center of the ejection port and is orthogonal to the major axis direction of the ejection port (shown by a line β in FIG. 7A).

Since the long side parts of the ejection electrode make a high contribution to the electric field formation at the ejection portion and provide a substantially effective function, the electric field that is substantially symmetric with respect to the surface which passes through the center of the ejection port and is parallel to or orthogonal to the major axis direction of the ejection port is generated by forming the ejection electrode in the shape as the above described one. Whereby, the ejection positions of ink droplets become stable, and the ink droplets adhering positions can be consistent. Therefore, it becomes possible to form images more stably, so that high quality images can be drawn.

Further, the ejection electrode shown in FIG. 7A is formed in a shape in which a part thereof on the upstream side in the ink flow direction is removed. Therefore, as described above, the ink particles supplying property to the ejection port is enhanced, and the ink droplets adhering positions can be stable.

Figure 7B:
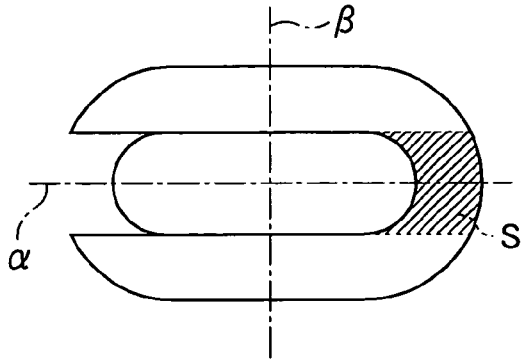
Figure 7C:
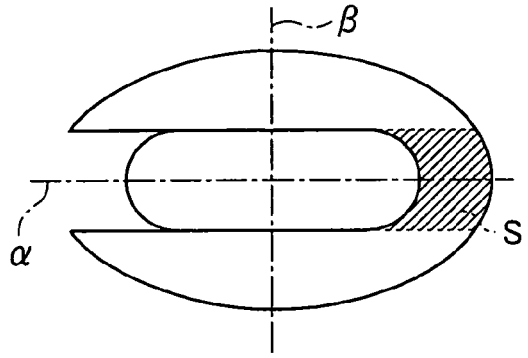

In FIG. 7A, the ejection electrode is formed in a channel shape in which a part of a rectangular frame on the upstream side in the ink flow direction is removed, however, it is not limited thereto. For example, as shown in FIG. 7B, the ejection electrode may be such that both short sides of a rectangular frame shaped ejection electrode are formed in a semicircular shape to have an elongated cocoon shape and a part thereof on the upstream side in the ink flow direction is removed. Alternatively, as shown in FIG. 7C, the ejection electrode may be formed in an oval shape whose major axis extends in the direction parallel to the ink flow direction and in which a part thereof on the upstream side in the ink flow direction is removed. Still alternatively, as shown in FIG. 7D, a parallel electrode in which rectangular electrodes are disposed to be parallel to the major axis direction of the ejection port may also be favorably used.

Figure 7D:
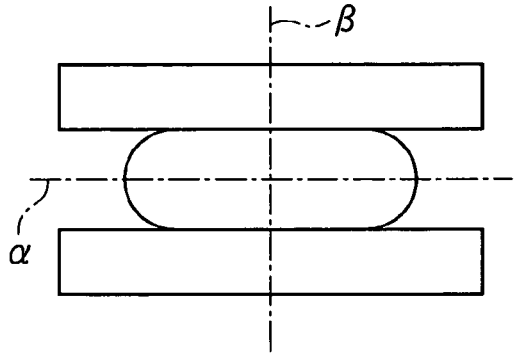

As shown in FIGS. 7A to 7D, the ejection electrode is formed to be symmetric with respect to the surface which passes through the center of the ejection port and is parallel to the major axis direction of the ejection port (shown by the line α in FIGS. 7A to 7D). Moreover, remaining parts of the respective ejection electrodes in FIGS. 7A to 7C in the case where the shaded area S is removed, as well as the rectangular electrodes in FIG. 7D are each symmetric with respect to the surface which passes through the center of the ejection port and is orthogonal to the major axis direction of the ejection port (shown by the line β in FIGS. 7A to 7D). Whereby, the ink droplets adhering positions can be stable, so that images with higher quality can be drawn.

In FIGS. 7B to 7D, a part of the ejection electrode on the upstream side in the ink flow direction is removed as in the case of the ejection electrode shown in FIG. 7A, so that the capability of supplying particles to the ejection port can be enhanced.

Figure 7E:
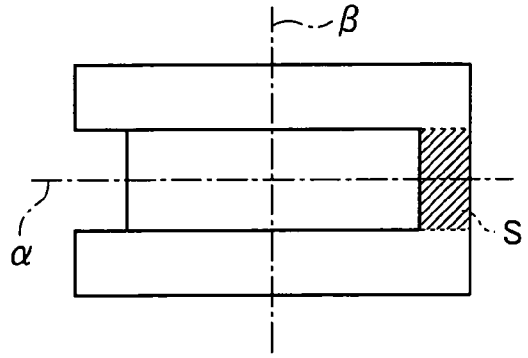

The ejection port is not limited to have the elongated cocoon shape so long as the aspect ratio between the major axis and the minor axis of the opening is 1 or more. For example, in the case where the ejection port has a rectangular shape as shown in FIG. 7E, similarly to the case of the above described elongated cocoon shaped ejection port, the ejection positions of ink droplets become stable by forming the ejection electrode to be symmetric with respect to the surface which passes through the center of the ejection port and is parallel to the major axis direction of the ejection port (shown by the line α in FIG. 7E) and by making each long side part of the ejection electrode (each remaining part of the ejection electrode in the case where the shaded area S in FIG. 7E is removed) symmetric with respect to the surface which passes through the center of the ejection port and is orthogonal to the major axis direction of the ejection port (shown by the line β in FIG. 7E).

The major axis direction of the ejection port is not limited to be parallel to the ink flow direction, and may be any arbitrary direction so long as the following conditions are satisfied, i.e., the ejection electrode is formed to be symmetric with respect to the surface which passes through the center of the ejection port and is parallel to the major axis direction of the ejection port, and each long side part of the ejection electrode is symmetric with respect to the surface which passes through the center of the ejection port and is orthogonal to the major axis direction of the ejection port. Whereby, it is possible to make the ejection positions of ink droplets stable.

Figure 7F:
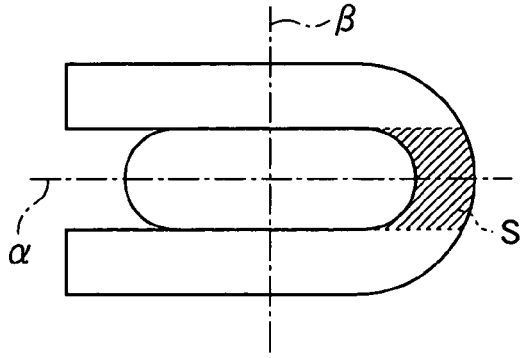

For easily forming the electric field which is substantially symmetric with respect to the ejection port, it is preferable that the ejection electrode be formed to be symmetric with respect to the surface which passes through the center of the ejection port and is parallel to the major axis direction of the ejection port, and each long side part of the ejection electrode be symmetric with respect to the surface which passes through the center of the ejection port and is orthogonal to the major axis direction of the ejection port. However, it is not limited thereto so long as a part of the ejection electrode which effectively contributes to the ejection of ink droplets is formed to be substantially symmetric with respect to the ejection port. As one example, as shown in FIG. 7F, the ejection electrode has a U-shape with its semicircular portion positioned on the downstream side in the ink flow direction, and each long side part thereof (each remaining part of the ejection electrode in the case where the shaded area S in FIG. 7F is removed) is asymmetric with respect to the surface which passes through the center of the ejection port and is orthogonal to the major axis direction of the ejection port (shown by the line β in FIG. 7F).

Even in this case, the electric field which is substantially symmetric with respect to the ejection port, that is, substantially symmetric with respect to a point, i.e., the center of the ejection port, or the electric field which is substantially symmetric with respect to the surface which passes through the center of the ejection port and is orthogonal to the major axis direction of the ejection port is formed. Whereby, it is possible to make the ejection positions of ink droplets stable.

In FIGS. 7A to 7F, the ejection electrode has a shape in which a part thereof is removed, however, it is not limited thereto. For example, an electrode with no part removed such as a circular electrode, an oval electrode, a rectangular electrode or the like can also be used so long as a part of the ejection electrode which effectively contributes to the ejection of ink droplets is formed to be substantially symmetric with respect to the ejection port (preferably, with respect to the surface which passes through the center of the ejection port and is parallel to the major axis direction of the ejection port), and each long side part of the ejection electrode is symmetric with respect to the surface which passes through the center of the ejection port and is orthogonal to the major axis direction of the ejection port. Whereby, it is possible to make the ejection positions of ink droplets stable.

Further, the shape of the ejection electrode is not limited to the above examples. The ejection electrode may be symmetric with respect to the surface which passes through the center of the ejection port and is parallel to the major axis direction of the ejection port, and each long side part of the ejection electrode extending in the major axis direction of the ejection port may be longer than the ejection port in the major axis direction. Alternatively, the ejection electrode may be symmetric with respect to the axis which passes through the center of the ejection port and is parallel to the major axis direction of the ejection port, and the center of each long side part of the ejection electrode extending in the major axis direction of the ejection port may be on the surface which passes through the center of the ejection port and is orthogonal to the major axis direction of the ejection port. Still alternatively, the ejection electrode may be symmetric with respect to the surface which passes through the center of the ejection port and is parallel to the major axis direction of the ejection port, and the center of each long side part of the ejection electrode extending in the major axis direction of the ejection port may be on the surface which passes through the center of the ejection port and is orthogonal to the major axis direction of the ejection port. Whereby, it is possible to make the ejection positions of ink droplets stable.

In the ink jet head 10 shown in FIGS. 1A and 1B, the ejection electrode 18 is exposed to the ink flow path 30 and is hence in contact with the ink Q in the ink flow path 30.

Therefore, when the drive voltage is applied to the ejection electrode 18 that is in contact with the ink Q in the ink flow path 30 (ejection ON), part of electric charges supplied to the ejection electrode 18 is injected into the ink Q, which increases the electric conductivity of the ink Q which is located between the ejection port 28 and the ejection electrode 18. Therefore, in the ink jet head 10 of this embodiment, the ink Q is readily ejected in the form of the ink droplets R (ejection property is enhanced) when the drive voltage is applied to the ejection electrode 18 (ejection ON).

Further, even at the time of non-ejection of ink droplets, that is, even when the drive voltage is not applied, by applying the voltage which is identical in polarity to that of the colorant particles to the ejection electrode 18, electric charges are injected into ink even at the time of non-ejection of ink, which further increases the electric conductivity of ink. Further, by forming the ejection electrode in a channel shape in which a part thereof on the upstream side is removed, the charged colorant particles floating in the ink flowing from the upstream side in the ink flow direction can be surely kept at the ejection portion 28 by the electrostatic force generated from the ejection electrode.

As described above, according to the ink jet head of the present embodiment, it is possible to prevent the electric field interference between the adjacent ejection portions from occurring. Further, the head itself can be compact, and the insulating properties among the ejection electrodes can be maintained, thus enabling fine droplets to be stably ejected at high frequency.

The ink used in the ink jet head 10 of the present invention will be described.

The ink Q is obtained by dispersing colorant particles in a carrier liquid. The carrier liquid is preferably a dielectric liquid (non-aqueous solvent) having a high electrical resistivity (equal to or larger than $10^9$ Ω·cm, and preferably equal to or larger than $10^{10}$ Ω·cm). If the electrical resistance of the carrier liquid is low, the concentration of the colorant particles does not occur since the carrier liquid receives the injection of electric charges and is charged due to a drive voltage applied to the ejection electrodes. In addition, since there is also anxiety that the carrier liquid having a low electrical resistance causes the electrical conduction between adjacent ejection electrodes, the carrier liquid having a low electrical resistance is unsuitable for the present invention.

The relative permittivity of the dielectric liquid used as the carrier liquid is preferably equal to or smaller than 5, more preferably equal to or smaller than 4, and much more preferably equal to or smaller than 3.5. Such a range is selected for the relative permittivity, whereby an electric field effectively acts on the colorant particles contained in the carrier liquid to facilitate the electrophoresis of the colorant particles.

Note that the upper limit of the specific electrical resistance of the carrier liquid is desirably about $10^{16}$ Ω·cm, and the lower limit of the relative permittivity is desirably about 1.9. The reason why the electrical resistance of the carrier liquid preferably falls within the above-mentioned range is that if the electrical resistance becomes low, then the ejection of ink under a low electric field becomes worse. Also, the reason why the relative permittivity preferably falls within the above-mentioned range is that if the relative permittivity becomes high, then an electric field is relaxed due to the polarization of a solvent, and as a result the color of dots formed under this condition becomes light, or the bleeding occurs.

Preferred examples of the dielectric liquid used as the carrier liquid include straight-chain or branched aliphatic hydrocarbons, alicyclic hydrocarbons, aromatic hydrocarbons, and the same hydrocarbons substituted with halogens. Specific examples thereof include hexane, heptane, octane, isooctane, decane, isodecane, decalin, nonane, dodecane, isododecane, cyclohexane, cyclooctane, cyclodecane, benzene, toluene, xylene, mesitylene, Isopar C, Isopar E, Isopar G, Isopar H, Isopar L, Isopar M (Isopar: a trade name of EXXON Corporation), Shellsol 70, Shellsol 71 (Shellsol: a trade name of Shell Oil Company), AMSCO OMS, AMSCO 460 Solvent (AMSCO: a trade name of Spirits Co., Ltd.), a silicone oil (such as KF-96L, available from Shin-Etsu Chemical Co., Ltd.). The dielectric liquid may be used singly or as a mixture of two or more thereof.

For such colorant particles dispersed in the carrier liquid, colorants themselves may be dispersed as the colorant particles into the carrier liquid, but dispersion resin particles are preferably contained for enhancement of the fixing property. In the case where the dispersion resin particles are contained in the carrier liquid, in general, there is adopted a method in which pigments are covered with the resin material of the dispersion resin particles to obtain particles covered with the resin, or the dispersion resin particles are colored with dyes to obtain the colored particles.

As the colorants, pigments and dyes conventionally used in ink compositions for ink jet recording, (oily) ink compositions for printing, or liquid developers for electrostatic photography may be used.

Pigments used as colorants may be inorganic pigments or organic pigments commonly employed in the field of printing technology. Specific examples thereof include but are not particularly limited to known pigments such as carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanine pigments, quinacridone pigments, isoindolinone pigments, dioxazine pigments, threne pigments, perylene pigments, perinone pigments, thioindigo pigments, quinophthalone pigments, and metal complex pigments.

Preferred examples of dyes used as colorants include oil-soluble dyes such as azo dyes, metal complex salt dyes, naphthol dyes, anthraquinone dyes, indigo dyes, carbonium dyes, quinoneimine dyes, xanthene dyes, aniline dyes, quinoline dyes, nitro dyes, nitroso dyes, benzoquinone dyes, naphthoquinone dyes, phthalocyanine dyes, and metal phthalocyanine dyes.

Further, examples of the dispersion resin particles include rosins, rosin-modified phenol resin, alkyd resin, a (meth) acryl polymer, polyurethane, polyester, polyamide, polyethylene, polybutadiene, polystyrene, polyvinyl acetate, acetal-modified polyvinyl alcohol, and polycarbonate.

Of those, from the viewpoint of ease for particle formation, a polymer having a weight average molecular weight in a range of 2,000 to 1,000,000 and a polydispersity (weight average molecular weight/number average molecular weight) in a range of 1.0 to 5.0 is preferred. Moreover, from the viewpoint of ease for the fixation, a polymer in which one of a softening point, a glass transition point, and a melting point is in a range of 40° C. to 120° C. is preferred.

In the ink Q, the content of colorant particles (total content of colorant particles and dispersion resin particles) preferably falls within a range of 0.5 to 30 wt % for the overall ink, more preferably falls within a range of 1.5 to 25 wt %, and much more preferably falls within a range of 3 to 20 wt %. If the content of the colorant particles decreases, the following problems become easy to arise. The density of a printed image is insufficient, the affinity between the ink Q and the surface of the recording medium P becomes difficult to obtain to prevent an image firmly stuck to the surface of the recording medium P from being obtained, and so forth. On the other hand, if the content of the colorant particles increases, problems occur in that the uniform dispersion liquid becomes difficult to obtain, the clogging of the ink Q is easy to occur in the ink jet head or the like to make it difficult to obtain the consistent ink ejection, and so forth.

In addition, the average particle diameter of the colorant particles dispersed in the carrier liquid preferably falls within a range of 0.1 to 5 μm, more preferably falls within a range of 0.2 to 1.5 μm, and much more preferably falls within a range of 0.4 to 1.0 μm. Those particle diameters are measured with CAPA-500 (a trade name of a measuring apparatus manufactured by HORIBA Ltd.).

After the colorant particles and optionally a dispersing agent are dispersed in the carrier liquid, a charging control agent is added to the resultant carrier liquid to charge the colorant particles, and the charged colorant particles are dispersed in the resultant liquid to thereby produce the ink Q. Note that in dispersing the colorant particles in the carrier liquid, a dispersion medium may be added if necessary.

As the charging control agent, for example, various ones used in the electrophotographic liquid developer can be utilized. In addition, it is also possible to utilize various charging control agents described in "DEVELOPMENT AND PRACTICAL APPLICATION OF RECENT ELECTRONIC PHOTOGRAPH DEVELOPING SYSTEM AND TONER MATERIALS", pp. 139 to 148; "ELECTROPHOTOGRAPHY-BASES AND APPLICATIONS", edited by THE IMAGING SOCIETY OF JAPAN, and published by CORONA PUBLISHING CO. LTD., pp. 497 to 505, 1988; and "ELECTRONIC PHOTOGRAPHY" by Yuji Harasaki, 16(No. 2), p. 44, 1977.

Note that the colorant particles may be positively or negatively charged as long as the charged colorant particles are identical in polarity to the drive voltages applied to ejection electrodes.

In addition, the charging amount of the colorant particles is preferably in a range of 5 to 200 μC/g, more preferably in a range of 10 to 150 μC/g, and much more preferably in a range of 15 to 100 μC/g.

In addition, the electrical resistance of the dielectric solvent may be changed by adding the charging control agent in some cases. Thus, the distribution factor P defined below is preferably equal to or larger than 50%, more preferably equal to or larger than 60%, and much more preferably equal to or larger than 70%.

$$P=100\times(\sigma 1-\sigma 2)/\sigma 1$$

where σ1 is an electric conductivity of the ink Q, and σ2 is an electric conductivity of a supernatant liquid which is obtained by inspecting the ink Q with a centrifugal separator. Those electric conductivities were measured by using an LCR meter (AG-4311 manufactured by ANDO ELECTRIC CO., LTD.) and an electrode for liquid (LP-05 manufactured by KAWAGUCHI ELECTRIC WORKS, CO., LTD.) under a condition of an applied voltage of 5 V and a frequency of 1 kHz. In addition, the centrifugation was carried out for 30 minutes under a condition of a rotational speed of 14,500 rpm and a temperature of 23° C. using a miniature high speed cooling centrifugal machine (SRX-201 manufactured by TOMY SEIKO CO., LTD.).

The ink Q as described above is used, which results in that the colorant particles are likely to migrate and hence the colorant particles are easily concentrated.

The electric conductivity of the ink Q is preferably in a range of 100 to 3,000 pS/cm, more preferably in a range of 150 to 2,500 pS/cm, and much more preferably in a range of 200 to 2,000 pS/cm. The range of the electric conductivity as described above is set, resulting in that the applied voltages to the ejection electrodes are not excessively high, and also there is no anxiety to cause the electrical conduction between adjacent ejection electrodes.

In addition, the surface tension of the ink Q is preferably in a range of 15 to 50 mN/m, more preferably in a range of 15.5 to 45 mN/m, and much more preferably in a range of 16 to 40 mN/m. The surface tension is set in this range, resulting in that the applied voltages to the ejection electrodes are not excessively high, and also ink does not leak or spread to the periphery of the head to contaminate the head.

Moreover, the viscosity of the ink Q is preferably in a range of 0.5 to 5 mPa·sec, more preferably in a range of 0.6 to 3.0 mPa·sec, and much more preferably in a range of 0.7 to 2.0 mPa·sec.

The ink Q can be prepared for example by dispersing colorant particles into a carrier liquid to form particles and adding a charging control agent to a dispersion medium to allow the colorant particles to be charged. The following methods are given as the specific methods.

(1) A method including: previously mixing (kneading) a colorant and optionally dispersion resin particles; dispersing the resultant mixture into a carrier liquid using a dispersing agent when necessary; and adding a charging control agent thereto.

(2) A method including: adding a colorant and optionally dispersion resin particles and a dispersing agent into a carrier liquid at the same time for dispersion; and adding a charging control agent thereto.

(3) A method including adding a colorant and a charging control agent and optionally a dispersion resin particles and a dispersing agent into a carrier liquid at the same time for dispersion.

The ink used in the ink jet head of the present invention is not limited to the above described insulating ink, and the ink having the electric conductivity of $10^{-8}$ to 100 pS/cm can also be used.

Also, in the above embodiments, the colorant particles contain the colorant, however, the colorant particles do not necessarily contain the colorant. For example, fine particles composed only of the dispersion resin particles can also be used.

Further, the ink in which metallic fine particles are dispersed is also favorably used.

Figure 8A:
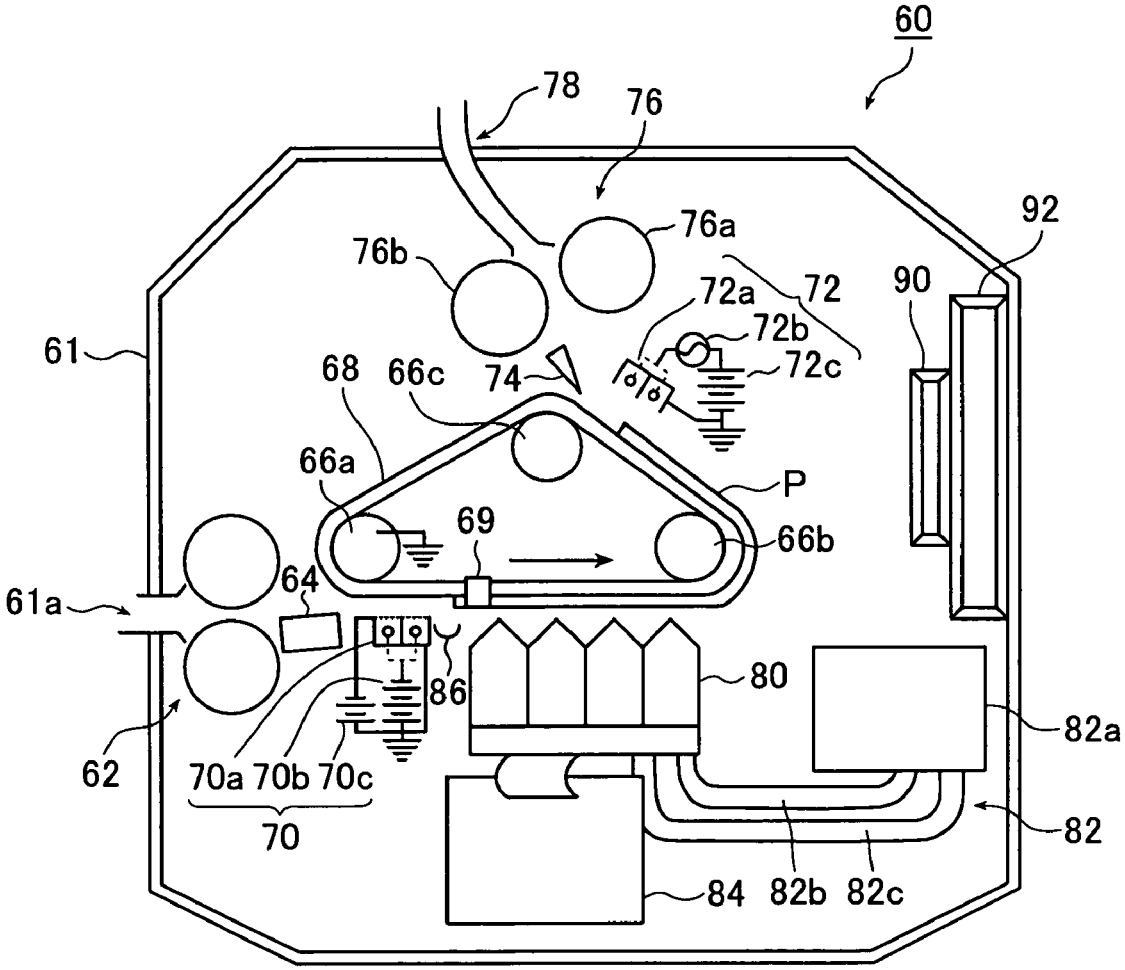
FIG. 8A is a conceptual diagram showing an ink jet recording device according to an embodiment of the present invention which utilizes the ink jet head of the present invention.

FIG. 8A is a conceptual diagram of an embodiment of an ink jet recording device of the present invention which utilizes the ink jet head of the present invention.

An ink jet recording device 60 (hereinafter, referred to as a printer 60) shown in FIG. 8A is a device for performing four-color one-side printing on the recording medium P. The printer 60 includes conveying means for the recording medium P, image recording means, and solvent collecting means, all of which are accommodated in a casing 61.

The conveying means includes a feed roller pair 62, a guide 64, rollers 66*a*, 66*b*, and 66*c*, a conveyor belt 68, conveyor belt position detecting means 69, electrostatic attraction means 70, electrostatic elimination means 72, separation means 74, fixing/conveying means 76, and a guide 78. The image recording means includes a head unit 80, an ink circulation system 82, a head driver 84 and recording medium position detecting means 86. The solvent collecting means includes a discharge fan 90, and a solvent collecting unit 92.

In the conveying means for the recording medium P, the feed roller pair 62 is a conveying roller pair disposed in the vicinity of a feeding port 61*a* provided in a side surface of the casing 61. The feed roller pair 62 feeds the recording medium P fed from a not shown paper cassette to the conveyor belt 68 (a portion supported by the roller 66*a* in FIG. 8A). The guide 64 is disposed between the feed roller pair 62 and the roller 66*a* for supporting the conveyor belt 68 and guides the recording medium P fed by the feed roller pair 62 to the conveyor belt 68.

Foreign matter removal means for removing foreign matter such as dust or paper powder adhered to the recording medium P is preferably disposed in the vicinity of the feed roller pair 62.

As the foreign matter removal means, one or more of known methods including non-contact removal methods such as suction removal, blowing removal and electrostatic removal, and contact removal methods such as removal using a blush, a roller, etc., may be used in combination. It is also possible that the feed roller pair 62 is composed of a slightly adhesive roller, a cleaner is prepared for the feed roller pair 62, and foreign matter such as dust or paper powder is removed when the feed roller pair 62 feeds the recording medium P.

The conveyor belt 68 is an endless belt stretched around the three rollers 66*a*, 66*b*, and 66*c*. At least one of the rollers 66*a*, 66*b*, and 66*c* is connected to a not shown drive source to rotate the conveyor belt 68.

At the time of image recording by the head unit 80, the conveyor belt 68 functions as conveying means for scanning the recording medium P and also as a platen for holding the recording medium P. After the end of image recording, the conveyor belt 68 further conveys the recording medium P to the fixing/conveying means 76. Therefore, the conveyor belt 68 is preferably made of a material which is excellent in dimension stability and has durability. For example, the conveyor belt 68 is made of a metal, a polyimide resin, a fluororesin, another resin, or a complex thereof.

In the illustrated embodiment, the recording medium P is held on the conveyor belt 68 under electrostatic attraction. In correspondence with this, the conveyor belt 68 has insulating properties on a side on which the recording medium P is held (front face), and conductive properties on the other side on which the belt 68 contacts the rollers 66*a*, 66*b*, and 66*c* (rear face). Further, in the illustrated embodiment, the roller 66*a* is a conductive roller, and the rear face of the conveyor belt 68 is grounded via the roller 66*a*.

In other words, when the conveyor belt 68 holds the recording medium P, the conveyor belt 68 also functions as the counter electrode 24 including the electrode substrate 24*a* and the insulating sheet 24*b* shown in FIG. 1A.

A belt having a metal layer and an insulating material layer manufactured by a variety of methods, such as a metal belt coated with any of the above described resin materials, for example, fluororesin on the front face, a belt obtained by bonding a resin sheet to a metal belt with an adhesive or the like, and a belt obtained by vapor-depositing a metal on the rear face of a belt made of the above-mentioned resin, may be used as the conveyor belt 68.

The conveyor belt 68 preferably has the flat front face contacting the recording medium P, whereby satisfactory attraction properties of the recording medium P can be obtained.

Meandering of the conveyor belt 68 is preferably suppressed by a known method. An example of a meandering suppression method is that the roller 66*c* is composed of a tension roller, a shaft of the roller 66*c* is inclined with respect to the shafts of the rollers 66*a* and 66*b* in response to an output of the conveyor belt position detecting means 69, that is, a position of the conveyor belt 68 detected in a width direction, thereby changing a tension at both ends of the conveyor belt in the width direction to suppress the meandering. The rollers 66*a*, 66*b*, and 66*c* may have a taper shape, a crown shape, or another shape to suppress the meandering.

The conveyor belt position detecting means 69 suppresses the meandering of the conveyor belt etc. in the above manner and detects the position of the conveyor belt 68 in the width direction to regulate the recording medium P to situate at a predetermined position in the scanning/conveying direction at the time of image recording. Known detecting means such as a photo sensor may be used.

The electrostatic attraction means 70 charges the recording medium P to a predetermined bias voltage with respect to the head unit 80 (above described ink jet head), and charges the recording medium P to have a predetermined potential such that the recording medium P is attracted to and held on the conveyor belt 68 under electrostatic force.

In the illustrated embodiment, the electrostatic attraction means 70 includes a scorotron charger 70*a* for charging the recording medium P, a high voltage power source 70*b* connected to the scorotron charger 70*a*, and a bias voltage source 70*c*. The corona wire of the scorotron charger 70*a* is connected to the terminal of the high voltage power source 70*b* on the negative side, and the terminal of the high voltage power source 70*b* on the positive side and the metallic shield case of the scorotron charger 70*a* are grounded. The terminal of the bias voltage source 70*c* on the negative side is connected to the grid electrode of the scorotron charger 70*a*, and the terminal of the bias voltage source 70*c* on the positive side is grounded.

While being conveyed by the feed roller pair 62 and the conveyor belt 68, the recording medium P is charged to a negative bias voltage by the scorotron charger 70*a* connected to the high voltage power source 70*b* and electrostatically attracted to the insulating layer of the conveyor belt 68.

Note that the conveying speed of the conveyor belt 68 when charging the recording medium P may be in a range where the charging is performed with stability, so the speed may be the same as, or different from, the conveying speed at the time of image recording. Also, the electrostatic attraction means may act on the same recording medium P several times by circulating the recording medium P several times on the conveyor belt 68 for uniform charging.

In the illustrated embodiment, the electrostatic attraction and the charging for the recording medium P are performed in the electrostatic attraction means 70, but the electrostatic attraction means and the charging means may be provided separately.

The electrostatic attraction means is not limited to the scorotron charger 70*a* of the illustrated example, a scorotron charger, a solid-state charger, an electrostatic discharge needle and various means and methods can be employed. As will be described in detail later, another method may be adapted in which at least one of the rollers 66*a*, 66*b*, and 66*c* is composed of a conductive roller or a conductive platen is disposed on the rear side of the conveyor belt 68 in a recording position for the recording medium P (side opposite to the recording medium P), and the conductive roller or the conductive platen is connected to the negative high voltage power source, thereby forming the electrostatic attraction means 70. Alternatively, it is also possible that the conveyor belt 68 is composed of an insulating belt and the conductive roller is grounded to connect the conductive platen to the negative high voltage power source.

The conveyor belt 68 conveys the recording medium P charged by the electrostatic attraction means 70 to the position where the head unit 80 to be described later is located.

An ink jet head applying the control method of the ink jet head of the present invention is used as the head unit 80. Ink droplets are ejected in accordance with image data from the head unit 80 to thereby record an image on the recording medium P. The ink jet head of the present invention uses a charge potential of the recording medium P for the bias voltage and applies a drive voltage to the ejection electrodes 18, whereby the drive voltage is superposed on the bias voltage and the ink droplets R are ejected to record an image on the recording medium P. At this time, the conveyor belt 68 is provided with heating means to increase the temperature of the recording medium P, thus promoting fixing of the ink droplets R on the recording medium P and further suppressing ink bleeding, which leads to improvement in image quality.

Image recording using the head unit 80 and the like will be described in detail,below.

The recording medium P on which the image is formed is subjected to electrostatic elimination by the electrostatic elimination means 72 and separated from the conveyor belt 68 by the separation means 74 and thereafter, conveyed to the fixing/conveying means 76.

In the illustrated embodiment, the electrostatic elimination means 72 is a so-called AC corotron charger, which includes a corotron charger 72*a*, an AC voltage source 72*b*, and a high voltage power source 72*c*. The corona wire of the corotron charger 72*a* is connected to the high voltage power source 72*c* through the AC voltage source 72*b*, and the other end of the high voltage power source 72*c* and the metallic shield case of the corotron charger 72*a* are grounded. In addition thereto, various means and methods, for example, a scorotron charger, a solid-state charger, and an electrostatic discharge needle can be used for electrostatic elimination means. Also, as in the electrostatic attraction means 70 described above, a structure using a conductive roller or a conductive platen can also be preferably utilized.

A known technique using a separation blade, a counter-rotating roller, an air knife or the like is applicable to the separation means 74.

The recording medium P separated from the conveyor belt 68 is sent to the fixing/conveying means 76 where the image formed by means of the ink jet recording is fixed. A pair of rollers composed of a heat roller 76*a* and a conveying roller 76*b* is used as the fixing/conveying means 76 to heat and fix the recorded image while nipping and conveying the recording medium P.

The recording medium P on which the image is fixed is guided by the guide 78 and delivered to a not shown delivered paper tray.

In addition to the heat roll fixation described above, examples of the heat fixing means include irradiation with infrared rays or using a halogen lamp or a xenon flash lamp, and general heat fixation such as hot air fixation using a heater. Further, in the fixing/conveying means 76, it is also possible that the heating means is used only for heating, and the conveying means and the heat fixing means are provided separately.

It should be noted that in the case of heat fixation, when a sheet of coated paper or laminated paper is used as the recording medium P, there is a possibility of causing a phenomenon called "blister" in which irregularities are formed on the sheet surface since moisture inside the sheet abruptly evaporates due to rapid temperature increase. To avoid this, it is preferable that a plurality of fixing devices be arranged, and at least one of power supply to the respective fixing devices and a distance from the respective fixing devices to the recording medium P be changed such that the temperature of the recording medium P gradually increases.

The printer 60 is preferably constructed such that no component will contact the image recording surface of the recording medium P at least during a process from the image recording with the head unit 80 to the completion of fixation with the fixing/conveying means 76.

Further, the movement speed of the recording medium P at the time of fixation with the fixing/conveying means 76 is not particularly limited, and may be the same as, or different from, the speed of the recording medium conveyed by the conveyor belt 68 at the time of image formation. When the movement speed is different from the conveying speed at the time of image formation, it is also preferable to provide a speed buffer for the recording medium P immediately before the fixing/conveying means 76.

Image recording using the printer 60 will be described in detail below.

As described above, the image recording means of the printer 60 includes the head unit 80 for ejecting ink, the ink circulation system 82 that supplies the ink Q to the head unit 80 and recovers the ink Q from the head unit 80, the head driver 84 that drives the head unit 80 based on an output image signal from a not-shown external apparatus such as a computer or a raster image processor (RIP), and the recording medium position detecting means 86 for detecting the recording medium P in order to determine an image recording position on the recording medium P.

Figure 8B:
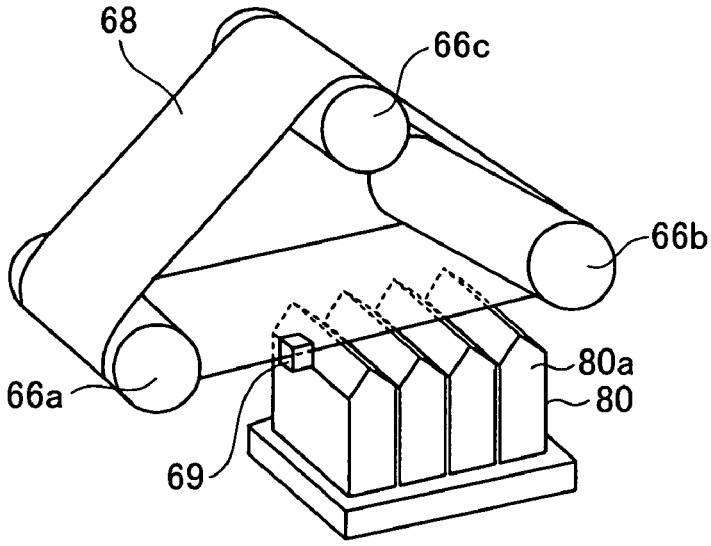
FIG. 8B is a perspective view schematically showing a head unit and conveying means for conveying a recording medium provided in a periphery of the head unit.

FIG. 8B is a schematic perspective view showing the head unit 80 and the conveying means for the recording medium P on the periphery thereof.

The head unit 80 includes four ink jet heads 80*a* for four colors of cyan (C), magenta (M), yellow (Y), and black (K) for recording a full-color image, and records an image on the recording medium P conveyed by the conveyor belt 68 at a predetermined speed by ejecting the ink Q supplied by the ink circulation system 82 as the ink droplets R in accordance with signals from the head driver 84 to which image data was supplied. The ink jet heads 80*a* for the respective colors are arranged along a conveying direction of the conveyor belt 68.

The ink jet head 80*a* of the head unit 80 for each color is the ink jet head of the present invention.

In the illustrated example, each ink jet head 80*a* is a line head including ejection ports 28 disposed in the entire area in the width direction of the recording medium P. The ink jet head 80*a* is preferably a multi-channel head as shown in FIG. 3, which has multiple nozzle lines, arranged in a staggered shape.

Therefore, in the illustrated embodiment, while the recording medium P is held on the conveyor belt 68, the recording medium P is conveyed to pass over the head unit 80 once. In other words, scanning and conveying of the recording medium P are performed only once. Then, an image is formed on the entire surface of the recording medium P. Therefore, image recording (drawing) at a higher speed is possible compared to serial scanning by the ejection head.

Note that the ink jet head of the present invention is also applicable to a so-called serial head (shuttle type head), and therefore the printer 60 may take this configuration.

In this case, the head unit 80 is structured such that a line (which may have a single line or multi channel structure) of the ejection ports 28 for each ink jet head agrees with the conveying direction of the conveyor belt 68, and the head unit 80 is provided with scanning means which scans the recording medium P in a direction perpendicular to the conveying direction of the recording medium P. Any known scanning means can be used for scanning.

Image recording may be performed as in a usual shuttle type ink jet printer. In accordance with the length of the line of the ejection ports 28, the recording medium P is conveyed intermittently by the conveyor belt 68, and in synchronization with this intermittent conveying, the recording medium P is scanned by the head unit 80 when the recording medium P is at rest, whereby an image is formed on the entire surface of the recording medium P.

As described above, the image formed by the head unit 80 on the entire surface of the recording medium P is then fixed by the fixing/conveying means 76 while the recording medium P is nipped and conveyed by the fixing/conveying means 76.

The head driver 84 receives image data from a system control unit (not shown) that receives image data from an external apparatus and performs various processing on the image data, and drives the head unit 80 based on the image data.

The system control unit color-separates the image data received from the external apparatus such as a computer, an RIP, an image scanner, a magnetic disk apparatus, or an image data transmission apparatus. The system control unit then performs division computation into an appropriate number of pixels and an appropriate number of gradations to generate image data with which the head driver 84 can drive the head unit 80 (ink jet head). Also, the system control unit controls timings of ink ejection by the head unit 80 in accordance with conveying timings of the recording medium P by the conveyor belt 68. The ejection timings are controlled using an output from the recording medium position detecting means 86 or an output signal from an encoder arranged for the conveyor belt 68 or a drive means of the conveyor belt 68.

The recording medium position detecting means 86 detects the recording medium P being conveyed to a position at which an ink droplet is ejected from the head unit 80, and known detecting means such as photo sensor can be used.

When the number of the ejection portions to be controlled (the number of channels) is large as in the case where a line head is used, the head driver 84 may separate rendering to employ a known method such as resistance matrix type drive method or resistance diode matrix type drive method. Thus, it is possible to reduce the number of ICs used in the head driver 84 and suppress the size of a control circuit while lowering costs.

The ink circulation system 82 allows each ink Q to flow in the ink flow path 30 (see FIG. 1A) of the corresponding ink jet head 80*a* of the head unit 80. The ink circulation system 82 includes: an ink circulation unit 82*a* having ink tanks, pumps, replenishment ink tanks (not shown), etc. for respective four colors (C, M, Y, K) of ink; an ink supply system 82*b* for supplying the ink Q of each color from the corresponding ink tank of the ink circulation unit 82*a* to the ink flow path 30 of the corresponding ink jet head 80*a* of the head unit 80; and an ink recovery system 82*c* for recovering the ink Q from the ink flow path 30 of each ink jet head 80*a* of the head unit 80 into the ink circulation unit 82*a*.

An arbitrary system may be used for the ink circulation system 82 as long as this system supplies the link Q of each color from the ink tank to the head unit 80 through the ink supply system 82*b* and recovers the ink Q of each color from the head unit 80 to the ink tank through the ink recovery system 82*c* to allow ink circulation.

Each ink tank contains the ink Q of the corresponding color and the ink Q is supplied to the head unit 80 by means of a pump. Ejection of the ink from the head unit 80 lowers the concentration of the ink circulating in the ink circulation system 82. Therefore, it is preferable in the ink circulation system 82 that the ink concentration be detected by an ink concentration detecting unit and the ink tank be replenished as appropriate with ink from the replenishment ink tank to keep the ink concentration in a predetermined range.

Moreover, the ink tank is preferably provided with an agitator for suppressing precipitation/aggregation of solid components of ink and an ink temperature control unit for suppressing ink temperature change. The reason thereof is as follows. If the temperature control is not performed, the ink temperature changes due to ambient temperature change or the like. Thus, physical properties of ink are changed, which causes the dot diameter change. As a result, a high quality image may not be recorded in a consistent manner.

A rotary blade, an ultrasonic transducer, a circulation pump, or the like may be used for the agitator.

Any known method can be used for ink temperature control, as exemplified by a method in which the ink temperature is controlled with the ink temperature control unit which includes a heating element or a cooling element such as a heater and Peltier element provided in the head unit 80, the ink tank, an ink supply line or the like, and a temperature sensor like a thermostat. When arranged inside the ink tank, the temperature control unit is preferably arranged with the agitator such that temperature distribution in the ink tank is kept constant. Then, the agitator for keeping the concentration distribution in the tank constant may double as the agitator for suppressing the precipitation/aggregation of solid components of ink.

As described above, the printer 60 includes the solvent collecting means composed of the discharge fan 90 and the solvent collecting unit 92. The solvent collecting means collects the carrier liquid evaporated from the ink droplets ejected on the recording medium P from the head unit 80, in particular, the carrier liquid evaporated from the recording medium P at the time of fixing an image formed of the ink droplets.

The discharge fan 90 sucks air inside the casing 61 of the printer 60 to blow the air to the solvent collecting unit 92.

The solvent collecting unit 92 is provided with a solvent vapor adsorbent. This solvent vapor adsorbent adsorbs solvent vapor containing gaseous solvent components aspirated by the discharge fan 90, and the gas is exhausted to the outside of the casing 61 of the printer 60 after the solvent has been adsorbed and collected. Various active carbons are preferably used as the solvent vapor absorber.

While the electrostatic ink jet recording device for recording a color image using the ink of four colors including C, M, Y, and K has been described, the present invention should not be construed restrictively; the apparatus may be a recording apparatus for a monochrome image or an apparatus for recording an image using an arbitrary number of other colors such as pale color ink and special color ink, for example. In such a case, the head units 80 and the ink circulation systems 82 whose number corresponds to the number of ink colors are used.

Furthermore, in the above embodiments, the ink jet recording system in which the ink droplets R are ejected by positively charging the colorant particles in the ink and charging the recording medium P or the counter electrode on the rear side of the recording medium P to the negative high voltage has been described. However, the present invention is not limited to this. Contrary to the above, the ink jet image recording may be performed by negatively charging the colorant particles in the ink and charging the recording medium or the counter electrode to the positive high voltage. When the charged color particles have the polarity opposite to that in the above-mentioned case, it is sufficient that the applied voltage to the electrostatic attraction means, the counter electrode, the drive electrode of the ink jet head, or the like is changed to have the polarity opposite to that in the above-mentioned case.

In the above embodiments, the ink jet recording device of the present invention is used as an ink jet printer, however, the present invention is not limited to this. The ink jet recording device may be used in an ink jet plate making apparatus.

Figure 9:
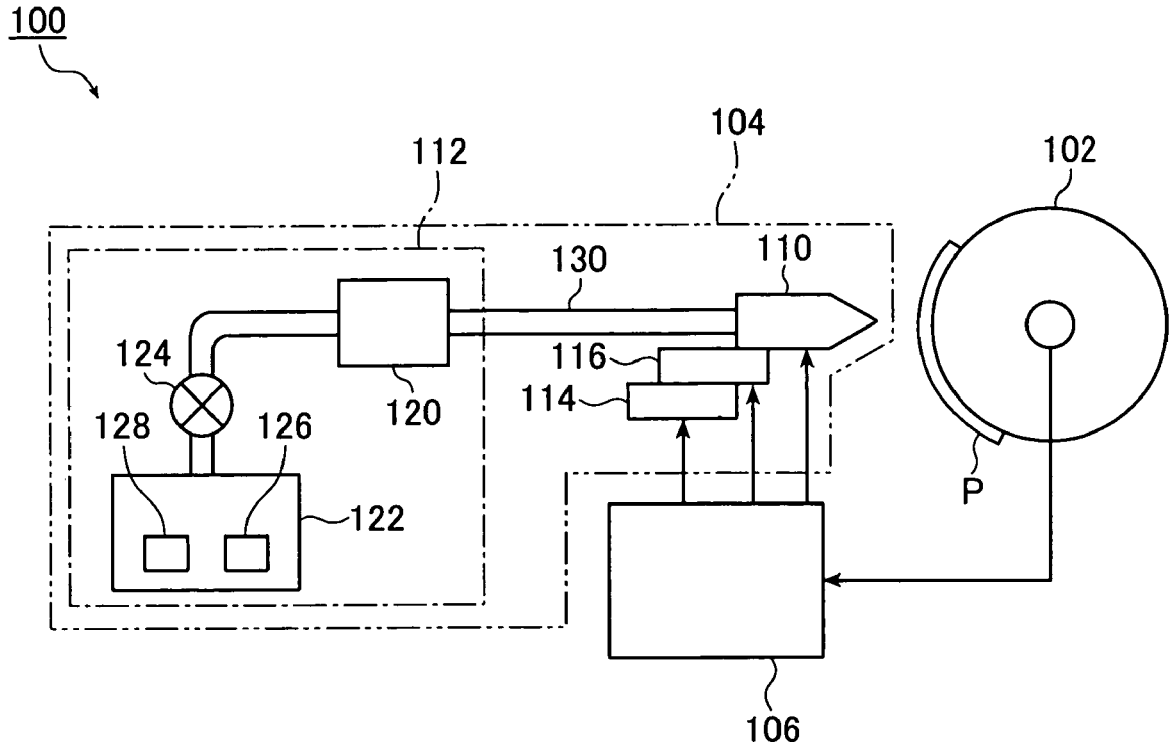
FIG. 9 is a conceptual diagram showing an ink jet plate making apparatus according to an embodiment of the present invention which utilizes the ink jet recording device of the present invention.

FIG. 9 shows a conceptual diagram of an embodiment of an ink jet plate making apparatus in which the ink jet recording device of the present invention is used.

The ink jet plate making apparatus 100 shown in FIG. 9 is an apparatus which uses a printing substrate (plate material) as the recording medium P, and makes a printing plate by forming an image on the plate material. The ink jet plate making apparatus 100 includes a drum 102 for supporting the recording medium P, an ink jet recording device 104, an image data arithmetic and control unit 106, a not shown automatic feeding unit for automatically feeding the recording medium P to the drum 102. The automatic feeding unit is a known unit which automatically feeds the recording medium P to the drum 102.

As shown in FIG. 9, the drum 102 is a cylindrical rotator for supporting the recording medium P.

The drum 102 is made of a metal such as an aluminum or a stainless steel, and functions as a counter electrode to an ink jet head 110 of the ink jet recording device 104. The drum 102 is connected to a not shown high voltage power source, and is in a state in which a high voltage is applied to its surface during image recording.

The drum 102 includes fixing means (not shown) for fixing the recording medium P. The recording medium P fed from the automatic feeding unit is fixed on the surface of the drum 102 by the fixing means. Examples of the fixing means include means that applies a method in which suction holes communicating with a suction unit are formed in the drum 102 and the recording medium P is fixed on the drum 102 by the suction force from the suction holes, means that applies a mechanical method such as a device for nipping the forward and rear ends of the recording medium P, a pressing roller or the like, and means that applies a method in which the recording medium P is electrostatically fixed on the drum 102.

The ink jet recording device 104 includes the ink jet head 110 as ink ejection means, ink supply means 112, head moving means 114 and head auxiliary scanning means 116.

The ink jet head 110 is disposed at a position facing the drum 102, and ejects ink droplets toward the recording medium P fixed on the surface of the drum 102 to thereby form an image. The ink jet head 110 has the same configuration as the above described ink jet head, so that the detailed explanation thereof is omitted here. As described above, the ink jet head 110 is an ink jet head which is compact and capable of drawing images with high quality and high definition.

The ink jet head 110 in this embodiment is a multi channel head comprising multiple ejection portions that are aligned to extend in the axis direction of the drum 102.

The ink supply means 112 includes an ink concentration control unit 120, an ink tank 122, and an ink pumping unit 124. Agitating means 126 and ink temperature control means 128 are provided in the ink tank 122.

The ink in the ink tank 122 is supplied to the ink jet head 110 through an ink supply tube 130 by the ink pumping unit 124. For instance, the ink pumping unit 124 can be composed of a pump. The ink supplied to the ink jet head 110 is recovered to the ink tank 122 through a not shown ink recovery tube. That is, the ink circulates in the ink jet head 110. As described above, the ink supply tube 130 and the not shown ink recovery tube connected to the ink jet head 110 are both composed of a tube having flexibility.

The agitating means 126 can suppress precipitation/aggregation of solid components of the ink, so that it is possible to reduce the need for cleaning the ink tank 122. As the agitating means 126, a rotary blade, an ultrasonic transducer, a circulation pump or the like may be used alone or in combination.

The ink temperature control means 128 detects the temperature of the ink in the ink tank 122 to keep it constant. Therefore, physical properties of the ink are prevented from changing due to the ambient temperature change, so that it is possible to prevent the dot diameter formed on the plate material from changing. Whereby, high quality images can be stably formed on the plate material. The ink temperature control means 128 can be composed of, for example, a temperature control element such as a heating element or a cooling element (e.g., a heater and Peltier element), a temperature sensor like a thermostat, and the like. The temperature control element may be arranged with agitating means so that temperature distribution in the ink tank 122 is kept constant. The ink temperature in the ink tank 122 is preferably 15° C. to 60° C., and more preferably 20° C. to 50° C. The agitating means for keeping the temperature distribution in the ink tank 122 constant may double as the agitating means for suppressing the precipitation/aggregation of solid components of the ink.

The ink jet recording device 104 in this embodiment includes the ink concentration control unit 120 for drawing high quality images. Whereby, the following phenomena can effectively be prevented, i.e., ink bleeds on the printing plate, or dropouts or a thin-spot occurs on the printing plate due to the concentration decrease of the solid components in the ink, the dot diameter formed on the printing plate changes due to the concentration increase of the solid components in the ink, and the like. Concentration of the ink is controlled by performing measurement of the physical properties (for example, by performing optical detection, measurement of electrical conductivity, measurement of viscosity or the like), by counting the number of printing plates made, or the like. In the case of controlling the concentration of the ink by performing measurement of the physical properties, an optical detector, an electrical conductance meter and a viscometer are provided individually or in combination in the ink tank 122 or on the ink flow path, and ink supply from a not shown concentrated ink tank for replenishment or ink carrier tank for dilution to the ink tank 122 is controlled based on the output signals therefrom. In the case of controlling the concentration of the ink by counting the number of printing plates made, the ink supply is controlled based on the number of printing plates made, the frequency of plate making, and the amount of ink ejected for making one printing plate.

The head moving means 114 moves the ink jet head 110 in the direction perpendicular to the axis direction of the drum 102, that is, the direction in which the ink jet head 110 becomes close to or apart from the drum 102. The head auxiliary scanning means 116 moves the ink jet head 110 in the direction parallel to the axis direction of the drum 102.

The image data arithmetic and control unit 106 color-separates the image data received from an image scanner, a magnetic disk apparatus, an image data transmission apparatus or the like if necessary. The image data arithmetic and control unit 106 then performs division computation into an appropriate number of pixels and an appropriate number of gradations. Further, the image data arithmetic and control unit 106 calculates the halftone dot area ratio for generating a halftone image by using the ink jet head 110. Further, the image data arithmetic and control unit 106 controls movement of the ink jet head, timings of ejection of ink droplets, and if necessary, the timings of operating the drum 102 and the like.

The data calculated in the image data arithmetic and control unit 106 is once stored in a buffer.

The image data arithmetic and control unit 106 rotates the drum 102, and moves the ink jet head 110 to the position close to the drum 102 using the head moving means 114. The distance between the ink jet head 110 and the recording medium P on the drum 102 is adjusted to a predetermined value during image drawing by controlling the head moving means based on the signals from a mechanical distance detector such as an abutting roller or an optical distance detector. The distance is adjusted in the manner described above, so that it becomes possible to perform favorable plate making without causing unevenness in the dot diameter due to floating of the recording medium from the drum 102 or the like, or particularly without causing any change in the dot diameter even when the plate making apparatus is vibrated.

The image data arithmetic and control unit 106 causes ink to be ejected onto the computed ejection positions on the surface of the recording medium P fixed on the drum 102 according to the computed halftone area ratio while moving the ink jet head 110 in the axis direction of the drum 102 by a predetermined distance each time the drum 102 is rotated once. The ink is ejected in the above manner, so that a halftone image corresponding to the tone of the printing original is drawn on the surface of the recording medium P. This operation continues until the ink image in one color of the printing original is formed on the surface of the recording medium P. The main scanning is performed by rotating the drum 102 in the above described manner, so that the positional accuracy in the main scanning direction can be improved and image drawing can be performed at high speed.

In this embodiment, the ink jet head used is the multi channel head, however, the present invention is not limited thereto. A full line head in which the length of the ink jet head 110 is approximately equal to the width of the drum 102 is also favorably used as the ink jet head 110.

When the full line head is used as the ink jet head, the ink image in one color of the printing original is formed on the surface of the drum 102 by one rotation of the drum 102.

Further, in the present invention, the recording medium is fixed on the drum to perform recording, however, the present invention is not limited thereto. Any system used in known recording apparatus can be favorably adapted, which includes a flat bed conveying system in which the recording medium placed on the bed is conveyed to record an image on the recording medium, a roller nip conveying system in which the recording medium is conveyed while being nipped between rollers to record an image on the recording medium, and the like.

The ink jet plate making apparatus of the present invention may include a fixing device for firmly fixing an ink image formed on the recording medium. Examples of the fixing means of ink include heat fixing means, and solvent fixing means. The heat fixing means generally used includes irradiation with infrared rays or using a halogen lamp or a xenon flash lamp, hot air fixation using a heater, and heat roll fixation. In this case, for enhancing the fixing property of ink, it is advantageous to use methods such as preheating a drum, preheating a recording medium, drawing an image while blowing hot air, coating a drum with a heat insulating material, and separating a recording medium from a drum during fixing of an ink image to heat only the recording medium individually or in combination. The flash fusing in which a xenon flash lamp or the like is used has been known as the method for fixing electrophotographic toner, and is advantageous because the fixation can be done in a short period of time. When a plate material made of paper is used as the recording medium, there is a possibility of causing a phenomenon called "blister" in which irregularities are formed on the surface of the recording medium since moisture inside the recording medium abruptly evaporates due to rapid temperature increase. To avoid this, it is preferable to gradually increase the temperature of a plate material made of paper. As in the case of the above described ink jet head, the heating device which scans the recording medium while facing the surface of the drum may be provided to heat the recording medium.

In the solvent fixing, a solvent capable of dissolving the resin components in the ink, such as methanol, or ethyl acetate is sprayed, or the recording medium is exposed to the vapor of the solvent, while recovering excess vapor of the solvent. It is preferable that no component contact an image on the recording medium at least during a process from the ink image formation with the ink jet recording device 104 to the completion of ink fixation with the fixing device.

The ink jet plate making apparatus of the present invention may be provided with a plate surface desensitizing device for enhancing the hydrophilicity on the surface of the recording medium according to need. The plate making apparatus may include dust removal means for removing dust present on the surface of the printing plate before and/or during drawing of an image on the recording medium. Whereby, the ink is effectively prevented from adhering to the plate material together with dust having entered the space between the head and the plate material during plate making, which enables proper plate making to be performed. As the dust removal means, known methods including non-contact removal methods such as suction removal, blowing removal and electrostatic removal, and contact removal methods such as removal using a blush, an adhesive roller, etc., may be used. In the present invention, preferably, air suction, air blowing, or a combination thereof is used.

The ink jet plate making apparatus of the present invention preferably includes an automatic plate discharging device for automatically discharging from the drum the recording medium on which an image has been recorded. Use of the automatic plate discharging device makes the plate making operation simpler and shortens the plate making time.

Next, the process for making a printing plate using the ink jet plate making apparatus 100 of the present invention will be explained.

First, the recording medium P is attached to the surface of the drum 102 using a not shown automatic plate supplying device. At this time, the recording medium P is tightly fixed on the surface of the drum 102 by not shown fixing means. Whereby, the recording medium P is prevented from being separated from the surface of the drum 102 and contacting the ink jet head 110 during image drawing to damage the ink jet head 110. It is also advantageous to use a method in which a pressing roller is disposed on the upstream and downstream sides with respect to the image drawing position on the drum 102, or the like. When image drawing is not performed, the ink jet head 110 is preferably kept apart from the recording medium P. Whereby, the ink jet head 110 can be effectively prevented from having troubles such as damage due to contact with the recording medium P and the like.

The thus obtained printing plate is used to perform printing by a known lithographic printing method. More specifically, the printing plate on which the ink image is formed is attached to a printing press, a printing ink and a fountain solution are applied onto the printing plate to form a printing ink image, the printing ink image is transferred to the blanket cylinder rotating together with the plate cylinder, and then the printing ink image on the blanket cylinder is transferred to a print sheet which passes between the blanket cylinder and the impression cylinder. Whereby, printing in one color is finished. The printing plate after the completion of the printing is removed from the plate cylinder, the blanket on the blanket cylinder is cleansed by the blanket cleansing device, and then the printing press is in a state ready for the next printing.

(Printing Substrate)

Next, the plate material (printing substrate) used for the ink jet plate making apparatus of the present invention will be explained. Examples of the printing substrate include metallic plates such as an aluminum plate and chromium-plated plate. Specially, an aluminum plate whose surface is subjected to graining and anodizing treatments to have excellent water retentivity and abrasion resistance is preferably used. Also, a plate material obtained by providing an image-receiving layer on a water-resistant support such as water-resistant paper, plastic film or plastic-laminated paper, may be used as a more inexpensive plate material. The thickness of the plate material is preferably 100 to 300 μm, and the thickness of the image-receiving layer in the plate material is preferably 5 to 30 μm.

The ink jet head, and the ink jet recording device and the ink jet plate making apparatus using the ink jet head according to the present invention have been explained above. However, it should be noted that the invention is by no means limited to the foregoing embodiments, and various improvements and modifications may of course be made without departing from the scope of the invention.

What is claimed is:

1. An ink jet head for ejecting ink as ink droplets through application of an electrostatic force to the ink, comprising:

ejection portions provided with ejection electrodes for applying the electrostatic force to the ink; and a shield electrode formed between adjacent ejection portions of said ejection portions for preventing electric field interference from occurring between adjacent ejection electrodes of said adjacent ejection portions, wherein the following formula (1) is satisfied $$Y \leqq 5 \times Va \quad (1)$$

where Va [V] is a drive voltage applied to said ejection electrodes, and Y [μm] is an arrangement interval between said adjacent ejection portions.

2. The ink jet head according to claim 1, wherein said shield electrode is covered with an insulating layer.

3. The ink jet head according to claim 1, wherein the following formula (2) is satisfied $$X \geqq 0.1 \times Vb \quad (2)$$

where X [μm] is a creeping distance between said adjacent ejection electrodes, and Vb [V] is a potential difference between said adjacent ejection electrodes.

4. An ink jet recording device, comprising:

an ink jet head for ejecting ink as ink droplets through application of an electrostatic force to the ink, wherein an image corresponding to image data is recorded on a recording medium using said ink jet head, and wherein said ink jet head comprises:

ejection portions provided with ejection electrodes for applying the electrostatic force to the ink; and a shield electrode formed between adjacent ejection portions of said ejection portions for preventing electric field interference from occurring between adjacent ejection electrodes of said adjacent ejection portions, wherein the following formula (1) is satisfied $$Y \leqq 5 \times Va \quad (1)$$

where Va [V] is a drive voltage applied to said ejection electrodes, and Y [μm] is an arrangement interval between said adjacent ejection portions.

5. The ink jet recording device according to claim 4, wherein said shield electrode is covered with an insulating layer.

6. The ink jet recording device according to claim 4, wherein the following formula (2) is satisfied $$X \geqq 0.1 \times Vb \quad (2)$$

where X [μm] is a creeping distance between said adjacent ejection electrodes, and Vb [V] is a potential difference between said adjacent ejection electrodes.

7. An ink jet plate making apparatus, comprising:

an ink jet recording device, wherein an image is formed on a printing substrate using said ink jet recording device to make a printing plate, wherein said ink jet recording device comprises:

an ink jet head for ejecting ink as ink droplets through application of an electrostatic force to the ink, wherein an image corresponding to image data is recorded on said printing substrate using said ink jet head, and wherein said ink jet head comprises:

ejection portions provided with ejection electrodes for applying the electrostatic force to the ink; and a shield electrode formed between adjacent ejection portions of said ejection portions for preventing electric field interference from occurring between adjacent ejection electrodes of said adjacent ejection portions, wherein the following formula (1) is satisfied $$Y \leqq 5 \times Va \quad (1)$$

where Va [V] is a drive voltage applied to said ejection electrodes, and Y [μm] is an arrangement interval between said adjacent ejection portions.

8. The ink jet plate making apparatus according to claim 7, wherein said shield electrode is covered with an insulating layer.

9. The ink jet plate making apparatus according to claim 7, wherein the following formula (2) is satisfied $$X \geqq 0.1 \times Vb \quad (2)$$

where X [μm] is a creeping distance between said adjacent ejection electrodes, and Vb [V] is a potential difference between said adjacent ejection electrodes.

* * * * *